US008715153B2

(12) United States Patent
Puria et al.

(10) Patent No.: US 8,715,153 B2
(45) Date of Patent: May 6, 2014

(54) OPTICALLY COUPLED BONE CONDUCTION SYSTEMS AND METHODS

(75) Inventors: Sunil Puria, Sunnyvale, CA (US); Rodney C. Perkins, Woodside, CA (US)

(73) Assignee: EarLens Corporation, Redwood City, CA (US)

( * ) Notice: Subject to any disclaimer, the term of this patent is extended or adjusted under 35 U.S.C. 154(b) by 491 days.

(21) Appl. No.: 12/820,767

(22) Filed: Jun. 22, 2010

(65) Prior Publication Data

US 2011/0152601 A1 Jun. 23, 2011

Related U.S. Application Data

(60) Provisional application No. 61/219,282, filed on Jun. 22, 2009.

(51) Int. Cl.
*H04R 25/00* (2006.01)

(52) U.S. Cl.
USPC ..... 600/25

(58) Field of Classification Search
USPC ..... 600/25, 126; 381/23.1, 312, 68; 607/55, 607/56, 57, 137; 181/129
See application file for complete search history.

(56) References Cited

U.S. PATENT DOCUMENTS 3,209,082 A 9/1965 McCarrell et al.
3,440,314 A 4/1969 Frisch
3,549,818 A 12/1970 Turner et al.
3,585,416 A 6/1971 Mellen
3,594,514 A 7/1971 Wingrove
3,710,399 A 1/1973 Hurst
3,712,962 A 1/1973 Epley
3,764,748 A * 10/1973 Branch et al. ..... 607/57
3,808,179 A 4/1974 Gaylord
3,882,285 A 5/1975 Nunley et al.

(Continued)

FOREIGN PATENT DOCUMENTS

DE 2044870 3/1972
DE 3243850 A1 5/1984

(Continued)

OTHER PUBLICATIONS

Robles et al. "Mechanics of the Mammalian Cochlea", Physiological Reviews, Jul. 1, 2001, pp. 1305-1352 vol. 81 No. 3.*

(Continued)

*Primary Examiner* — John Lacyk
(74) *Attorney, Agent, or Firm* — Wilson Sonsini Goodrich & Rosati

(57) ABSTRACT

A hearing device can allow a user to determine from side which a sound originates with bone conduction vibration of the cochlea and the user can also receive sound localization cues from the device, as feedback can be substantially inhibited with bone conduction vibration of the cochlea. An output transducer assembly can be positioned on a first side of the user to vibrate a first bone tissue near a first cochlea with a first amount of energy, such vibration of a second cochlea on a second side with a second amount of energy is attenuated substantially, for example at least about 6 db, such that the user can localize the sound to the first side. A microphone may be located on the first side and coupled to the output transducer assembly, such that the user localizes the sound to the first side detects sound localization cues.

36 Claims, 16 Drawing Sheets

(56) References Cited

U.S. PATENT DOCUMENTS 3,985,977 A 10/1976 Beaty et al.
4,002,897 A 1/1977 Kleinman et al.
4,061,972 A 12/1977 Burgess
4,075,042 A 2/1978 Das
4,098,277 A 7/1978 Mendell
4,109,116 A 8/1978 Victoreen
4,120,570 A 10/1978 Gaylord
4,248,899 A 2/1981 Lyon et al.
4,252,440 A 2/1981 Frosch et al.
4,303,772 A 12/1981 Novicky
4,319,359 A 3/1982 Wolf
4,334,315 A 6/1982 Ono et al.
4,334,321 A 6/1982 Edelman
4,339,954 A 7/1982 Anson et al.
4,357,497 A 11/1982 Hochmair et al.
4,380,689 A 4/1983 Giannetti
4,428,377 A 1/1984 Zollner et al.
4,524,294 A 6/1985 Brody
4,540,761 A 9/1985 Kawamura et al.
4,556,122 A 12/1985 Goode
4,592,087 A 5/1986 Killion
4,606,329 A 8/1986 Hough
4,611,598 A 9/1986 Hortmann et al.
4,628,907 A 12/1986 Epley
4,641,377 A 2/1987 Rush et al.
4,654,554 A 3/1987 Kishi
4,689,819 A 8/1987 Killion
4,696,287 A 9/1987 Hortmann et al.
4,729,366 A 3/1988 Schaefer
4,741,339 A 5/1988 Harrison et al.
4,742,499 A 5/1988 Butler
4,756,312 A 7/1988 Epley
4,766,607 A 8/1988 Feldman
4,774,933 A 10/1988 Hough et al.
4,776,322 A 10/1988 Hough et al.
4,782,818 A 11/1988 Mori
4,800,884 A 1/1989 Heide et al.
4,800,982 A 1/1989 Carlson
4,817,607 A 4/1989 Tatge
4,840,178 A 6/1989 Heide et al.
4,845,755 A 7/1989 Busch et al.
4,865,035 A 9/1989 Mori
4,932,405 A 6/1990 Peeters et al.
4,936,305 A 6/1990 Ashtiani et al.
4,944,301 A 7/1990 Widin et al.
4,948,855 A 8/1990 Novicky
4,957,478 A * 9/1990 Maniglia ..... 600/25
4,982,434 A * 1/1991 Lenhardt et al. ..... 381/326
4,999,819 A 3/1991 Newnham et al.
5,003,608 A 3/1991 Carlson
5,012,520 A 4/1991 Steeger
5,015,224 A 5/1991 Mariglia
5,015,225 A 5/1991 Hough et al.
5,031,219 A 7/1991 Ward et al.
5,061,282 A 10/1991 Jacobs
5,066,091 A 11/1991 Stoy et al.
5,094,108 A 3/1992 Kim et al.
5,117,461 A 5/1992 Moseley
5,142,186 A 8/1992 Cross et al.
5,163,957 A 11/1992 Sade et al.
5,167,235 A 12/1992 Seacord et al.
5,201,007 A 4/1993 Ward et al.
5,259,032 A 11/1993 Perkins et al.
5,272,757 A 12/1993 Scofield et al.
5,276,910 A 1/1994 Buchele
5,277,694 A 1/1994 Leysieffer et al.
5,338,287 A * 8/1994 Miller et al. ..... 600/25
5,360,388 A 11/1994 Spindel et al.
5,378,933 A 1/1995 Pfannenmueller et al.
5,402,496 A 3/1995 Soli et al.
5,411,467 A 5/1995 Hortmann et al.
5,425,104 A 6/1995 Shennib
5,440,082 A 8/1995 Claes
5,440,237 A 8/1995 Brown et al.
5,455,994 A 10/1995 Termeer et al.
5,456,654 A 10/1995 Ball
5,531,787 A 7/1996 Lesinski et al.
5,531,954 A 7/1996 Heide et al.
5,535,282 A 7/1996 Luca
5,554,096 A 9/1996 Ball
5,558,618 A 9/1996 Maniglia
5,572,594 A 11/1996 Devoe et al.
5,606,621 A 2/1997 Reiter et al.
5,624,376 A 4/1997 Ball et al.
5,707,338 A 1/1998 Adams et al.
5,715,321 A 2/1998 Andrea et al.
5,721,783 A 2/1998 Anderson
5,722,411 A 3/1998 Suzuki et al.
5,729,077 A 3/1998 Newnham et al.
5,740,258 A 4/1998 Goodwin-Johansson
5,749,912 A 5/1998 Zhang et al.
5,762,583 A 6/1998 Adams et al.
5,772,575 A 6/1998 Lesinski et al.
5,774,259 A 6/1998 Saitoh et al.
5,782,744 A 7/1998 Money
5,788,711 A 8/1998 Lehner et al.
5,795,287 A 8/1998 Ball et al.
5,797,834 A 8/1998 Goode
5,800,336 A 9/1998 Ball et al.
5,804,109 A 9/1998 Perkins
5,804,907 A 9/1998 Park et al.
5,814,095 A 9/1998 Muller et al.
5,825,122 A 10/1998 Givargizov et al.
5,836,863 A 11/1998 Bushek et al.
5,842,967 A 12/1998 Kroll
5,857,958 A 1/1999 Ball et al.
5,859,916 A 1/1999 Ball et al.
5,879,283 A 3/1999 Adams et al.
5,888,187 A 3/1999 Jaeger et al.
5,897,486 A 4/1999 Ball et al.
5,899,847 A 5/1999 Adams et al.
5,900,274 A 5/1999 Chatterjee et al.
5,906,635 A 5/1999 Maniglia
5,913,815 A 6/1999 Ball et al.
5,922,077 A 7/1999 Espy et al.
5,935,170 A * 8/1999 Håkansson et al. ..... 600/25
5,940,519 A 8/1999 Kuo
5,949,895 A 9/1999 Ball et al.
5,984,859 A 11/1999 Lesinski
5,987,146 A 11/1999 Pluvinage et al.
6,005,955 A 12/1999 Kroll et al.
6,024,717 A 2/2000 Ball et al.
6,045,528 A 4/2000 Arenberg et al.
6,050,933 A 4/2000 Bushek et al.
6,068,589 A 5/2000 Neukermans
6,068,590 A 5/2000 Brisken
6,084,975 A 7/2000 Perkins
6,093,144 A 7/2000 Jaeger et al.
6,137,889 A 10/2000 Shennib et al.
6,139,488 A 10/2000 Ball
6,153,966 A 11/2000 Neukermans
6,174,278 B1 1/2001 Jaeger et al.
6,181,801 B1 1/2001 Puthuff et al.
6,190,305 B1 2/2001 Ball et al.
6,190,306 B1 2/2001 Kennedy
6,208,445 B1 3/2001 Reime
6,217,508 B1 4/2001 Ball et al.
6,222,302 B1 4/2001 Imada et al.
6,222,927 B1 4/2001 Feng et al.
6,240,192 B1 5/2001 Brennan et al.
6,241,767 B1 6/2001 Stennert et al.
6,261,224 B1 7/2001 Adams et al.
6,277,148 B1 8/2001 Dormer
6,312,959 B1 11/2001 Datskos
6,339,648 B1 1/2002 McIntosh et al.
6,354,990 B1 3/2002 Juneau et al.
6,366,863 B1 4/2002 Bye et al.
6,385,363 B1 5/2002 Rajic et al.
6,387,039 B1 5/2002 Moses
6,393,130 B1 5/2002 Stonikas et al.
6,422,991 B1 7/2002 Jaeger
6,432,248 B1 8/2002 Popp et al.
6,436,028 B1 8/2002 Dormer
6,438,244 B1 8/2002 Juneau et al.

(56) References Cited

U.S. PATENT DOCUMENTS

| | | | | |
|---|---|---|---|---|
| 6,445,799 | B1 | 9/2002 | Taenzer et al. | |
| 6,473,512 | B1 | 10/2002 | Juneau et al. | |
| 6,475,134 | B1 | 11/2002 | Ball et al. | |
| 6,491,644 | B1 | 12/2002 | Vujanic et al. | |
| 6,491,722 | B1 * | 12/2002 | Kroll et al. | 623/10 |
| 6,493,453 | B1 | 12/2002 | Glendon | |
| 6,493,454 | B1 | 12/2002 | Loi et al. | |
| 6,498,858 | B2 | 12/2002 | Kates | |
| 6,519,376 | B2 | 2/2003 | Biagi et al. | |
| 6,536,530 | B2 | 3/2003 | Schultz et al. | |
| 6,537,200 | B2 | 3/2003 | Leysieffer et al. | |
| 6,549,633 | B1 | 4/2003 | Westermann | |
| 6,554,761 | B1 | 4/2003 | Puria et al. | |
| 6,575,894 | B2 | 6/2003 | Leysieffer et al. | |
| 6,592,513 | B1 | 7/2003 | Kroll et al. | |
| 6,603,860 | B1 | 8/2003 | Taezner et al. | |
| 6,620,110 | B2 | 9/2003 | Schmid | |
| 6,626,822 | B1 | 9/2003 | Jaeger et al. | |
| 6,629,922 | B1 | 10/2003 | Puria et al. | |
| 6,643,378 | B2 * | 11/2003 | Schumaier | 381/326 |
| 6,668,062 | B1 | 12/2003 | Luo et al. | |
| 6,676,592 | B2 | 1/2004 | Ball et al. | |
| 6,695,943 | B2 | 2/2004 | Juneau et al. | |
| 6,724,902 | B1 | 4/2004 | Shennib et al. | |
| 6,728,024 | B2 | 4/2004 | Ribak | |
| 6,735,318 | B2 | 5/2004 | Cho | |
| 6,754,358 | B1 | 6/2004 | Boeson et al. | |
| 6,754,537 | B1 | 6/2004 | Harrison et al. | |
| 6,801,629 | B2 | 10/2004 | Brimhall et al. | |
| 6,829,363 | B2 | 12/2004 | Sacha | |
| 6,842,647 | B1 | 1/2005 | Griffith et al. | |
| 6,888,949 | B1 | 5/2005 | Vanden Berghe et al. | |
| 6,900,926 | B2 | 5/2005 | Ribak | |
| 6,912,289 | B2 | 6/2005 | Vonlanthen et al. | |
| 6,920,340 | B2 | 7/2005 | Laderman | |
| 6,940,989 | B1 | 9/2005 | Shennib et al. | |
| D512,979 | S | 12/2005 | Corcoran et al. | |
| 6,975,402 | B2 | 12/2005 | Bisson et al. | |
| 6,978,159 | B2 | 12/2005 | Feng et al. | |
| 7,043,037 | B2 | 5/2006 | Lichtblau | |
| 7,050,675 | B2 | 5/2006 | Zhou | |
| 7,057,256 | B2 | 6/2006 | Carey, III et al. | |
| 7,058,182 | B2 | 6/2006 | Kates | |
| 7,072,475 | B1 | 7/2006 | DeNap et al. | |
| 7,076,076 | B2 | 7/2006 | Bauman | |
| 7,095,981 | B1 | 8/2006 | Voroba et al. | |
| 7,167,572 | B1 | 1/2007 | Harrison et al. | |
| 7,174,026 | B2 | 2/2007 | Niederdrank | |
| 7,203,331 | B2 | 4/2007 | Boesen | |
| 7,239,069 | B2 | 7/2007 | Cho | |
| 7,245,732 | B2 | 7/2007 | Jorgensen et al. | |
| 7,255,457 | B2 | 8/2007 | Ducharme et al. | |
| 7,289,639 | B2 * | 10/2007 | Abel et al. | 381/312 |
| 7,322,930 | B2 | 1/2008 | Jaeger et al. | |
| 7,349,741 | B2 | 3/2008 | Maltan et al. | |
| 7,354,792 | B2 | 4/2008 | Carey, III et al. | |
| 7,376,563 | B2 | 5/2008 | Leysieffer et al. | |
| 7,390,689 | B2 | 6/2008 | Mazur et al. | |
| 7,394,909 | B1 | 7/2008 | Widmer et al. | |
| 7,421,087 | B2 | 9/2008 | Perkins et al. | |
| 7,424,122 | B2 | 9/2008 | Ryan | |
| 7,444,877 | B2 | 11/2008 | Li et al. | |
| 7,547,275 | B2 | 6/2009 | Cho | |
| 7,668,325 | B2 | 2/2010 | Puria et al. | |
| 2001/0003788 | A1 | 6/2001 | Ball et al. | |
| 2001/0027342 | A1 | 10/2001 | Dormer | |
| 2001/0043708 | A1 | 11/2001 | Brimhall | |
| 2001/0053871 | A1 | 12/2001 | Zilberman et al. | |
| 2001/0055405 | A1 | 12/2001 | Cho | |
| 2002/0012438 | A1 | 1/2002 | Leysieffer et al. | |
| 2002/0029070 | A1 | 3/2002 | Leysieffer et al. | |
| 2002/0030871 | A1 | 3/2002 | Anderson et al. | |
| 2002/0035309 | A1 | 3/2002 | Leysieffer | |
| 2002/0086715 | A1 | 7/2002 | Sahagen | |
| 2002/0172350 | A1 | 11/2002 | Edwards et al. | |
| 2002/0183587 | A1 | 12/2002 | Dormer | |
| 2003/0064746 | A1 | 4/2003 | Rader et al. | |
| 2003/0097178 | A1 | 5/2003 | Roberson et al. | |
| 2003/0125602 | A1 | 7/2003 | Sokolich et al. | |
| 2003/0142841 | A1 | 7/2003 | Wiegand | |
| 2003/0208099 | A1 | 11/2003 | Ball | |
| 2004/0165742 | A1 | 8/2004 | Shennib et al. | |
| 2004/0184732 | A1 | 9/2004 | Zhou | |
| 2004/0208333 | A1 | 10/2004 | Cheung et al. | |
| 2004/0234089 | A1 | 11/2004 | Rembrand et al. | |
| 2004/0234092 | A1 | 11/2004 | Wada et al. | |
| 2004/0240691 | A1 | 12/2004 | Grafenberg | |
| 2005/0020873 | A1 | 1/2005 | Berrang et al. | |
| 2005/0036639 | A1 | 2/2005 | Bachler et al. | |
| 2005/0163333 | A1 | 7/2005 | Abel et al. | |
| 2005/0226446 | A1 | 10/2005 | Luo et al. | |
| 2006/0023908 | A1 | 2/2006 | Perkins et al. | |
| 2006/0058573 | A1 | 3/2006 | Neisz et al. | |
| 2006/0062420 | A1 | 3/2006 | Araki | |
| 2006/0107744 | A1 * | 5/2006 | Li et al. | 73/657 |
| 2006/0161255 | A1 | 7/2006 | Zarowski et al. | |
| 2006/0177079 | A1 | 8/2006 | Baekgaard Jensen et al. | |
| 2006/0183965 | A1 | 8/2006 | Kasic, II et al. | |
| 2006/0189841 | A1 * | 8/2006 | Pluvinage | 600/25 |
| 2006/0231914 | A1 | 10/2006 | Carey, III et al. | |
| 2006/0233398 | A1 | 10/2006 | Husung | |
| 2007/0083078 | A1 | 4/2007 | Easter et al. | |
| 2007/0100197 | A1 | 5/2007 | Perkins et al. | |
| 2007/0127748 | A1 * | 6/2007 | Carlile et al. | 381/312 |
| 2007/0135870 | A1 | 6/2007 | Shanks et al. | |
| 2007/0161848 | A1 | 7/2007 | Dalton et al. | |
| 2007/0191673 | A1 | 8/2007 | Ball et al. | |
| 2007/0225776 | A1 | 9/2007 | Fritsch et al. | |
| 2007/0236704 | A1 | 10/2007 | Carr | |
| 2007/0250119 | A1 | 10/2007 | Tyler et al. | |
| 2007/0251082 | A1 | 11/2007 | Milojevic et al. | |
| 2007/0286429 | A1 | 12/2007 | Grafenberg et al. | |
| 2008/0021518 | A1 | 1/2008 | Hochmair et al. | |
| 2008/0051623 | A1 | 2/2008 | Schneider et al. | |
| 2008/0107292 | A1 | 5/2008 | Kornagel | |
| 2008/0188707 | A1 | 8/2008 | Bernard et al. | |
| 2008/0298600 | A1 | 12/2008 | Poe et al. | |
| 2009/0023976 | A1 | 1/2009 | Cho et al. | |
| 2009/0043149 | A1 | 2/2009 | Abel et al. | |
| 2009/0092271 | A1 | 4/2009 | Fay et al. | |
| 2009/0097681 | A1 | 4/2009 | Puria et al. | |
| 2009/0141919 | A1 | 6/2009 | Spitaels et al. | |
| 2010/0034409 | A1 | 2/2010 | Fay et al. | |
| 2010/0048982 | A1 | 2/2010 | Puria et al. | |
| 2010/0312040 | A1 | 12/2010 | Puria et al. | |
| 2010/0317914 | A1 | 12/2010 | Puria et al. | |

FOREIGN PATENT DOCUMENTS

| | | | |
|---|---|---|---|
| DE | 3508830 | A1 | 9/1986 |
| EP | 0 242 038 | A2 | 10/1987 |
| EP | 0 291 325 | A2 | 11/1988 |
| EP | 0 296 092 | | 12/1988 |
| EP | 0 352 954 | A2 | 1/1990 |
| EP | 1435757 | A1 | 7/2004 |
| EP | 1 845 919 | A1 | 10/2007 |
| FR | 2455820 | | 11/1980 |
| JP | 60-154800 | | 8/1985 |
| JP | 09-327098 | | 12/1997 |
| KR | 10-0624445 | B1 | 9/2006 |
| WO | WO 92/09181 | A1 | 5/1992 |
| WO | WO 97/36457 | A1 | 10/1997 |
| WO | WO 97/45074 | A1 | 12/1997 |
| WO | WO 98/06236 | A1 | 2/1998 |
| WO | WO 99/03146 | | 1/1999 |
| WO | WO 99/15111 | | 4/1999 |
| WO | WO 01/50815 | A1 | 7/2001 |
| WO | WO 01/58206 | A2 | 8/2001 |
| WO | WO 02/39874 | A2 | 5/2002 |
| WO | WO 03/030772 | A2 | 4/2003 |
| WO | WO 03/063542 | A2 | 7/2003 |
| WO | WO 2004/010733 | A1 | 1/2004 |
| WO | WO 2005/015952 | | 2/2005 |
| WO | WO 2006/042298 | A2 | 4/2006 |

(56) References Cited

FOREIGN PATENT DOCUMENTS

| | | | |
|---|---|---|---|
| WO | WO 2006/071210 | A1 | 7/2006 |
| WO | WO 2006/075169 | | 7/2006 |
| WO | WO 2006/075175 | | 7/2006 |
| WO | WO 2009/047370 | A2 | 4/2009 |
| WO | WO 2009/056167 | A1 | 5/2009 |

OTHER PUBLICATIONS

Atasoy [Paper] "Opto-acoustic Imaging" for BYM504E Biomedical Imaging Systems class at ITU, downloaded from the Internet <<http://www2.itu.edu.tr/~cilesiz/courses/BYM504-2005-OA_504041413.pdf>>, 14 pages, presented May 13, 2005.
Athanassiou et al., "Laser Controlled Photomechanical Actuation of Photochromic Polymers Microsystems" Rev. Adv. Mater. Sci., 2003; 5:245-251.
Ayatollahi et al., "Design and Modeling of Micromachined Condenser MEMS Loudspeaker using Permanent Magnet Neodymium-Iron-Boron (Nd—Fe—B)," IEEE International Conference on Semiconductor Electronics, 2006. ICSE '06, Oct. 29, 2006-Dec. 1, 2006; pp. 160-166.
Baer et al., "Effects of Low Pass Filtering on the Intelligibility of Speech in Noise for People With and Without Dead Regions at High Frequencies," J Acoust Soc Am. Sep. 2002;112(3 Pt 1):1133-1144.
Best et al., "Influence of High Frequencies on Speech Locatisation," Abstract 981, Feb. 24, 2003, retrieved from: http://www.aro.org/abstracts.html.
Birch et al., "Microengineered Systems for the Hearing Impaired," IEE Colloquium on Medical Applications of Microengineering, Jan. 31, 1996; pp. 2/1-2/5.
Burkhard et al., "Anthropometric Manikin for Acoustic Research," J Acoust Soc Am. Jul. 1975;58(1):214-22.
Camacho-Lopez et al., "Fast Liquid Crystal Elastomer Swims Into the Dark," Electronic Liquid Crystal Communications, (Nov. 26, 2003), 9 pages total.
Carlile et al., Abstract 1264—"Spatialisation of Talkers and the Segregation of Concurrent Speech ," Feb. 24, 2004, retrieved from: http://www.aro.org/archives/2004/2004_1264.html.
Cheng et al., "A Silicon Microspeaker for Hearing Instruments," Journal of Micromechanics and Microengineering 2004; 14(7):859-866.
Datskos et al., "Photoinduced and Thermal Stress in Silicon Microcantilevers", Applied Physics Letters, Oct. 19, 1998; 73(16):2319-2321.
Decraemer et al., "A Method for Determining Three-Dimensional Vibration in the Ear," Hearing Research, 77 (1-2): 19-37 (1994).
Ear, Retrieved from the Internet: <<http://wwwmgs.bionet.nsc.ru/mgs/gnw/trrd/thesaurus/Se/ear.html>>, downloaded on Jun. 17, 2008, 4 pages total.
Fay, "Cat Ear Drum Mechanics," Ph.D. thesis, Dissertation submitted to Department of Aeronautics and Astronautics, Stanford University, May 2001, 210 pages total.
Fay et al., "Cat Eardrum Response Mechanics;" in Calladine Festschrift, edited by S. Pellegrino Kluwer Academic Publishers, The Netherlands, 2002; 10 pages total.
Fletcher, "Effects of Distortion on the Individual Speech Sounds", Chapter 18, ASA Edition of Speech and Hearing in Communication, Acoust Soc.of Am. (republished in 1995) pp. 415-423.
Freyman et al., "Spatial Release from Informational Masking in Speech Recognition," J Acoust Soc Am. May 2001;109(5 Pt 1):2112-2122.
Freyman et al., "The Role of Perceived Spatial Separation in the Unmasking of Speech," J Acoust Soc Am. Dec. 1999;106(6):3578-3588.
Gennum, GA3280 Preliminary Data Sheet: Voyageur TD Open Platform DSP System for Ultra Low Audio Processing, downloaded from the Internet: <<http://www.sounddesigntechnologies.com/products/pdf/37601DOC.pdf>>, Oct. 2006; 17 pages.
Hato et al., "Three-Dimensional Stapes Footplate Motion in Human Temporal Bones." Audiol Neurootol , 2003; 8: 140-152.
"Headphones" Wikipedia Entry, downloaded from the Internet : <<http://en.wikipedia.org/wiki/Headphones>>, downloaded on Oct. 27, 2008, 7 pages total.
Hofman et al., "Relearning Sound Localization With New Ears," Nat Neurosci. Sep. 1998;1(5):417-421.
Izzo et al., "Laser Stimulation of the Auditory Nerve," Lasers Surg Med. Sep. 2006;38(8):745-753.
Izzo et al, "Laser Stimulation of Auditory Neurons: Effect of Shorter Pulse Duration and Penetration Depth," Biophys J. Apr. 15, 2008;94(8):3159-3166.
Izzo et al., "Selectivity of Neural Stimulation in the Auditory System: A Comparison of Optic and Electric Stimuli," J Biomed Opt. Mar.-Apr. 2007;12(2):021008.
Jin et al., "Speech Localization", J. Audio Eng. Soc. convention paper, presented at the AES 112th Convention, Munich, Germany, May 10-13, 2002, 13 pages total.
Killion, "Myths About Hearing Noise and Directional Microphones," The Hearing Review, vol. 11, No. 2, (Feb. 2004), pp. 14, 16, 18, 19, 72 & 73.
Killion, "SNR loss: I can hear what people say but I can't understand them," The Hearing Review, 1997; 4(12):8-14.
Lee et al., "A Novel Opto-Electromagnetic Actuator Coupled to the tympanic Membrane" Journal of Biomechanics, 2008; 41(16): 3515-3518.
Lee et al., "The Optimal Magnetic Force for a Novel Actuator Coupled to the Tympanic Membrane: A Finite Element Analysis," Biomedical Engineering: Applications, Basis and Communications, 2007; 19(3):171-177.
Lezal, "Chalcogenide Glasses—Survey and Progress", J. Optoelectron Adv Mater., Mar. 2003; 5 (1):23-34.
Markoff, "Intuition + Money: An Aha Moment," New York Times Oct. 11, 2008, p. BU4, 3 pages total.
Martin et al. "Utility of Monaural Spectral Cues is Enhanced in the Presence of Cues to Sound-Source Lateral Angle," JARO, 2004; 5:80-89.
Moore, "Loudness Perception and Intensity Resolution" , Cochlear Hearing Loss, Whurr Publishers Ltd., (1998), Chapter 4, pp. 90-115.
Murugasu et al., "Malleus-to-footplate versus malleus-to-stapes-head ossicular reconstruction prostheses: temporal bone pressure gain measurements and clinical audiological data," Otol Neurotol. Jul. 2005;26(4):572-582.
Musicant et al., "Direction-Dependent Spectral Properties of Cat External Ear: New Data and Cross-Species Comparisons," J. Acostic. Soc. Am, May 10-13, 2002, Feb. 1990; 8(2):757-781.
National Semiconductor, LM4673 Boomer: Filterless, 2.65W, Mono, Class D Audio Power Amplifier, [Data Sheet] downloaded from the Internet: <<http://www.national.com/ds/LM/LM4673.pdf>>; Nov. 1, 2007; 24 pages.
O'Connor et al., "Middle ear Cavity and Ear Canal Pressure-Driven Stapes Velocity Responses in Human Cadaveric Temporal Bones," J Acoust Soc Am. Sep. 2006;120(3):1517-28.
Perkins et al., "The EarLens System: New sound transduction methods," Hear Res. Feb. 2, 2010; 10 pages total.
Poosanaas et al., "Influence of Sample thickness on the performance of Photostrictive ceramics," J. App. Phys., Aug. 1998; 84(3):1508-1512.
Puria et al., "Abstract 1112: A Gear in the Middle Ear," ARO Thirtieth Annual MWM, Denver CO, Feb. 13, 2007.
Puria et al., "Malleus-to-Footplate Ossicular Reconstruction Prosthesis Positioning: Cochleovestibular Pressure Optimization", Otol Neurotol. May 2005;26(3):368-379.
Puria and Allen; "Measurements and Model of the Cat Middle Ear: Evidence of Tympanic Membrane Acoustic Delay," Journal of the Acoustical Society of America, 1998; 104 (6): 3463-3481.
Puria et al., "Middle Ear Morphometry From Cadaveric Temporal Bone MicroCT Imaging," Proceedings of the 4th International Symposium, Zurich, Switzerland, Jul. 27-30, 2006, Middle Ear Mechanics in Research and Otology, pp. 259-268.
Puria et al.; "Sound-Pressure Measurements in the Cochlear Vestibule of Human-Cadaver Ears," Journal of the Acoustical Society of America, 101 (5-1): 2754-2770, (1997).
Roush, "SiOnyx Brings "Black Silicon" into the Light; Material Could Upend Solar, Imaging Industries," Xconomy, Oct. 12, 2008,

(56) References Cited

OTHER PUBLICATIONS retrieved from the Internet: <<http://www.xconomy.com/boston/2008/10/12/sionyx-brings-black-silicon-into-the-light-material-could-upend-solar-imaging-industries/>> 4 pages total.
Rubinstein, "How Cochlear Implants Encode Speech," Curr Opin Otolaryngol Head Neck Surg. Oct. 2004;12(5):444-8; retrieved from the Internet: <http://www.ohsu.edu/nod/documents/week3/Rubenstein.pdf>.
Sekaric et al., "Nanomechanical Resonant Structures as Tunable Passive Modulators," App. Phys. Lett., Nov. 2003; 80(19): 3617-3619.
Sound Design Technologies, "Voyager TD™ Open Platform DSP System for Ultra Low Power Audio Processing—GA3280 Data Sheet", Oct. 2007; retrieved from the Internet: <<http://www.sound-des.com/pdf/37601DOC.pdf>>, 15 page total.
Shaw, "Transformation of Sound Pressure Level From the Free Field to the Eardrum in the Horizontal Plane," J. Acoust. Soc. Am., Dec. 1974; 56(6):1848-1861.
Shih, "Shape and Displacement Control of Beams with Various Boundary Conditions via Photostrictive optical actuators," Proc. IMECE (Nov. 2003), pp. 1-10.
Shock, "How Deep Brain Stimulation Works for Parkinson's Disease" [website]; retrieved from the Internet: <http://www.shockmd.com/2009/05/11/how-deep-brain-stimulation-works-for-parkinsons-disease/> on Jun. 18, 2010, 6 pages total.
Stenfelt et al., "Bone-Conducted Sound: Physiological and Clinical Aspects," Otology & Neurotology, Nov. 2005; 26 (6):1245-1261.
Stuchlik et al, "Micro-Nano Actuators Driven by Polarized Light", IEEE Proc. Sci. Meas. Techn. Mar. 2004, 151(2):131-136.
Suski et al., "Optically Activated ZnO/SiO2/Si Cantilever Beams", Sensors ? Actuators, 1990; 24:221-225.
Takagi et al.; "Mechanochemical Synthesis of Piezoelectric PLZT Powder", KONA, 2003, 151(21):234-241.
Thakoor et al., "Optical Microactuation in Piezoceramics", Proc. SPIE, Jul. 1998; 3328:376-391.
Tzou et al; "Smart Materials, Precision Sensors/Actuators, Smart Structures, and Structronic Systems", Mechanics of Advanced Materials and Structures, 2004;11:367-393.
Uchino et al.; "Photostricitve actuators," Ferroelectrics 2001; 258:147-158.
Vickers et al., "Effects of Low-Pass Filtering on the Intelligibility of Speech in Quiet for People With and Without Dead Regions at High Frequencies," J Acoust Soc Am. Aug. 2001;110(2):1164-1175.
Vinikman-Pinhasi et al., "Piezoelectric and Piezooptic Effects in Porous Silicon," Applied Physics Letters, Mar. 2006; 88(11): 111905-111906.
Wang et al., "Preliminary Assessment of Remote Photoelectric Excitation of an Actuator for a Hearing Implant," Proceeding of the 2005 IEEE, Engineering in Medicine and Biology 27th Annual Conference, Shanghai, China, Sep. 1-4, 2005, pp. 6233-6234.
Wiener et al., "On the Sound PreSsure Transformation by the Head and Auditory Meatus of the Cat", Acta Otolaryngol. Mar. 1966;61(3):255-269.
Wightman et al., "Monaural Sound Localization Revisited," J Acoust Soc Am. Feb. 1997;101(2):1050-1063.
Yi et al., "Piezoelectric Microspeaker with Compressive Nitride Diaphragm," The Fifteenth IEEE International Conference on Micro Electro Mechanical Systems, 2002; pp. 260-263.
Yu et al. "Directed Bending of a Polymer Film by Light", Nature, Sep. 2003; 425(6954):145.
International Search Report and Written Opinion, of PCT Application No. PCT/US2010/039347, mailed Jan. 28, 2011, 9 pages total.
U.S. Appl. No. 60/702,532, filed Jul. 25, 2005, inventor: Nikolai Aljuri.
U.S. Appl. No. 61/099,087, filed Sep. 22, 2008, inventor: Paul Rucker.
European search report dated Oct. 24, 2012 for EP Application No. 10797545.0.

* cited by examiner

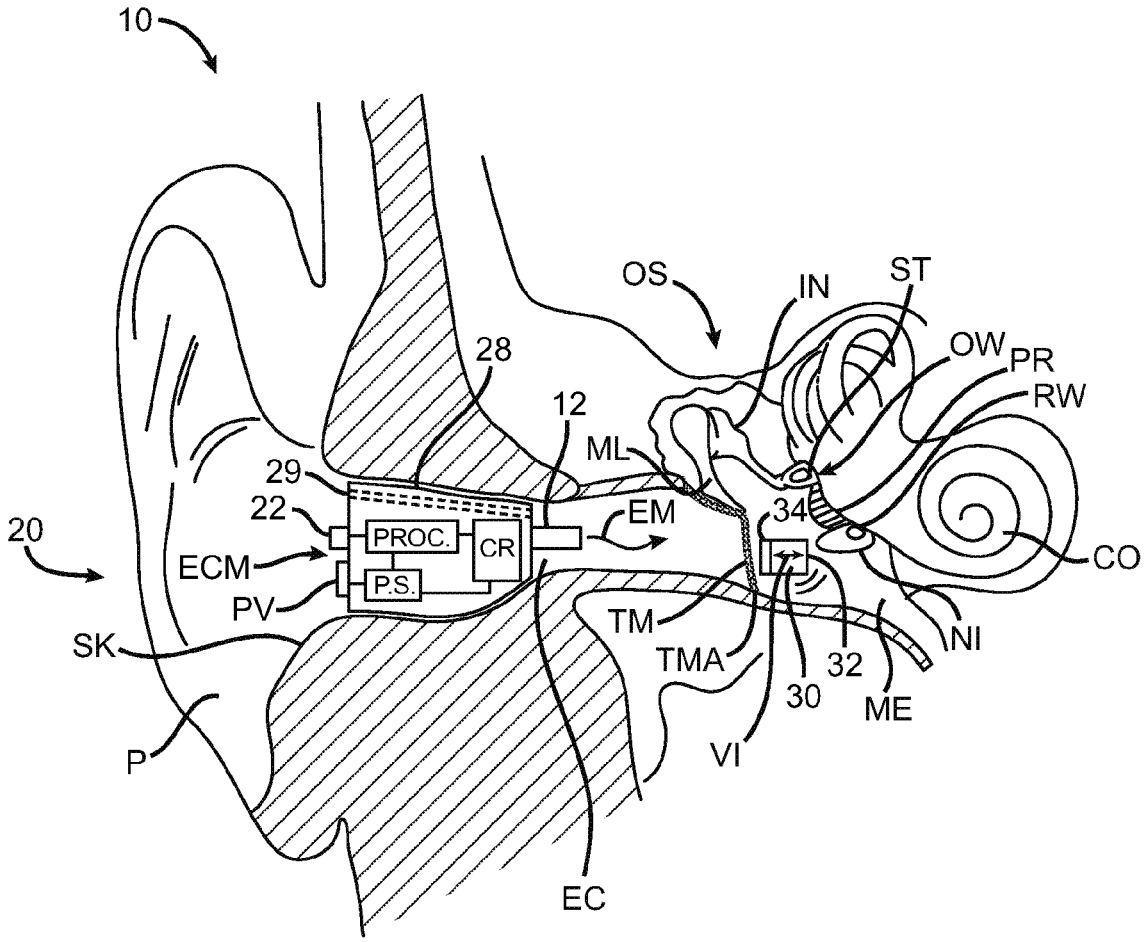
FIG. 1A1

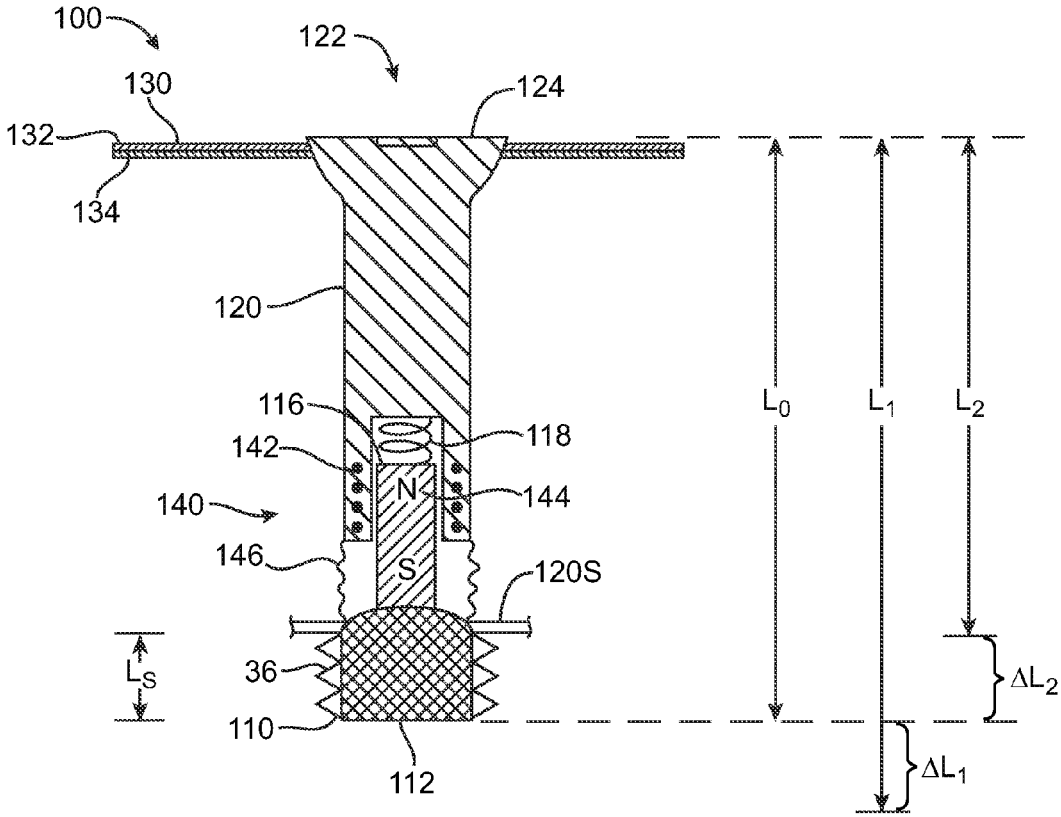
FIG. 1E1

OPTICALLY COUPLED BONE CONDUCTION SYSTEMS AND METHODS

CROSS-REFERENCES TO RELATED APPLICATIONS

The present application is a non-provisional and claims priority to U.S. application Ser. No. 61/219,282 filed on 22 Jun. 2009, entitled "Optically Coupled Bone Conduction Systems and Methods", the full disclosure of which is incorporated herein by reference.

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The present invention is related to hearing systems, devices and methods. Although specific reference is made to hearing aid systems, embodiments of the present invention can be used in many applications in which a signal is used to stimulate the ear.

People like to hear. Hearing allows people to listen to and understand others. Natural hearing can include spatial cues that allow a user to hear a speaker, even when background noise is present. People also like to communicate with those who are far away, such as with cellular phones.

Hearing devices can be used with communication systems to help the hearing impaired and to help people communicate with others who are far away. At least some hearing impaired people have a mixed hearing loss. With mixed hearing loss, a person may have a conductive hearing loss that occurs in combination with a sensorineural hearing loss. The conductive hearing loss may be due to diminished function of the conductive components of the ear such as the eardrum and ossicles that transmit sound from the ear canal to the cochlea. The sensorineural hearing loss may comprise diminished function of the cochlea, such that the cochlea does not convert sound waves to neural impulses as effectively as would be ideal.

Many of the prior therapies for mixed hearing loss and sensorineural hearing loss are less than ideal in at least some instances. One approach has been to replace, at least partially, one or more of the ossicles of the middle ear with an ossicular replacement prosthesis. Although the ossicular replacement prosthesis can improve the conductive portion of the mixed hearing loss, such treatment may leave the patient with diminished hearing due to the remaining sensorineural hearing loss in at least some instances.

Prior acoustic hearing devices such as conventional in the ear or behind the ear hearing aids may not be effective with patients having conductive hearing loss in at least some instances. For example, the patient may have atresia, which is an absence of the ear canal or failure of the canal to be tubular or fully formed. Further, such prior acoustic hearing devices can cause feedback at high frequencies and the frequency response may be limited to about 4 kHz such that sound localization cues may not be present with such devices in at least some instances.

A bone-anchored hearing aid (hereinafter "BAHA™") has been used to provide sound based on bone conduction. The bone-anchored devices can be suited to people who have conductive hearing losses, unilateral hearing loss and people with mixed hearing losses. Such people may not be well served with in the ear or behind the ear hearing aids. However, bone conduction hearing devices may not offer sound localization to the user in at least some instances, such that at least some people may not be able localize the source of sound in at least some instances. This lack of sound localization may make hearing difficult for the user in at least some instances. Also, with bone conduction hearing aids, a post may be surgically embedded into the skull with a small abutment extending through the skin, such that implantation of the device can be somewhat invasive and the post through the skin can be at risk for infection in at least some instances.

For the above reasons, it would be desirable to provide hearing systems which at least decrease, or even avoid, at least some of the above mentioned limitations of the prior prosthetic devices. For example, there is a need to provide a hearing prosthesis which provides hearing with natural qualities, for example with spatial information cues, and which allow the user to hear with less occlusion, distortion and feedback than the prior devices.

2. Description of the Background Art

Patents and publications that may be relevant to the present application include: U.S. Pat. Nos. 3,585,416; 3,764,748; 3,882,285; 4,498,461; 5,142,186; 5,360,388; 5,554,096; 5,624,376; 5,795,287; 5,800,336; 5,825,122; 5,857,958; 5,859,916; 5,888,187; 5,897,486; 5,913,815; 5,949,895; 6,005,955; 6,068,590; 6,093,144; 6,139,488; 6,174,278; 6,190,305; 6,208,445; 6,217,508; 6,222,302; 6,241,767; 6,422,991; 6,475,134; 6,519,376; 6,620,110; 6,626,822; 6,676,592; 6,728,024; 6,735,318; 6,900,926; 6,920,340; 7,072,475; 7,095,981; 7,239,069; 7,289,639; D512,979; 2002/0086715; 2003/0142841; 2004/0234092; 2005/0020873; 2006/0107744; 2006/0233398; 2006/075175; 2007/0083078; 2007/0191673; 2008/0021518; 2008/0107292; commonly owned U.S. Pat. Nos. 5,259,032; 5,276,910; 5,425,104; 5,804,109; 6,084,975; 6,554,761; 6,629,922; U.S. Publication Nos. 2006/0023908; 2006/0189841; 2006/0251278; and 2007/0100197. Non-U.S. patents and publications that may be relevant include EP1845919 PCT Publication Nos. WO 03/063542; WO 2006/075175; U.S. Publication Nos. Journal publications that may be relevant include: Ayatollahi et al., "Design and Modeling of Micromachines Condenser MEMS Loudspeaker using Permanent Magnet Neodymium-Iron-Boron (Nd—Fe—B)", ISCE, Kuala Lampur, 2006; Birch et al, "Microengineered Systems for the Hearing Impaired", IEE, London, 1996; Cheng et al., "A silicon microspeaker for hearing instruments", J. Micromech. Microeng., 14 (2004) 859-866; Yi et al., "Piezoelectric microspeaker with compressive nitride diaphragm", IEEE, 2006, and Zhigang Wang et al., "Preliminary Assessment of Remote Photoelectric Excitation of an Actuator for a Hearing Implant", IEEE Engineering in Medicine and Biology 27th Annual Conference, Shanghai, China, Sep. 1-4, 2005. Other publications of interest include: Gennum GA3280 Preliminary Data Sheet, "Voyager TDTM. Open Platform DSP System for Ultra Low Power Audio Processing" and National Semiconductor LM4673 Data Sheet, "LM4673 Filterless, 2.65W, Mono, Class D audio Power Amplifier"; Puria, S. et al., Middle ear morphometry from cadaveric temporal bone micro CT imaging, Invited Talk. MEMRO 2006, Zurich; Puria, S. et al, A gear in the middle ear ARO 2007, Baltimore, Md.; and Lee et al., "The Optimal Magnetic Force For A Novel Actuator Coupled to the Tympanic Membrane: A Finite Element Analysis," Biomedical Engineering: Applications, Basis and Communications, Vol. 19, No. 3(171-177), 2007; Stenfelt & Goode, Otology & Neurology, 26:1245-1261, 2005.

For the above reasons, it would be desirable to provide hearing systems which at least decrease, or even avoid, at least some of the above mentioned limitations of the prior hearing devices. For example, there is a need to provide a comfortable hearing device which provides hearing with natural qualities, for example with spatial information cues, and which allow the user to hear with less occlusion, distortion and feedback than prior devices.

BRIEF SUMMARY OF THE INVENTION

Embodiments of the present invention provide improved systems devices and methods that overcome at least some of the limitations of the prior hearing devices. The hearing device can allow a user to determine from which side a sound originates with bone conduction vibration of the cochlea and the user can also receive sound localization cues from the device, as feedback can be substantially inhibited with bone conduction vibration of the cochlea. An output transducer assembly can be positioned on a first side of the user to vibrate a first bone tissue near a first cochlea with a first amount of energy, such vibration of a second cochlea on a second side with a second amount of energy is attenuated substantially, for example at least about 6 db, such that the user can localize the sound to the first side. For example, a microphone may be located on the first side and coupled to the output transducer assembly to vibrate the first cochlea with the first energy and the second cochlea with the second energy, such that the user localizes the sound to the first side. The microphone may be placed in an ear canal of the first side, or outside the ear canal and within about 5 mm of the ear canal opening, such that the microphone can detect sound localization cues diffracted from the pinna, for example, and comprising frequencies of at least about 4 kHz, for example from about 4 kHz to 15 kHz. The first output transducer assembly can vibrate the first cochlea such that the user can determine a location of the sound on the first side with the sound localization cues. In many embodiments, a hearing system comprises a first output assembly on the first side and the second output assembly on the second side.

BRIEF DESCRIPTION OF THE DRAWINGS

FIG. 1A1 shows an input assembly of the system comprising an ear canal module, in accordance with embodiments of the present invention;

FIG. 1E1 shows a variable length assembly comprising a first component configured to affix to cochlear bone tissue and a second component configured to move opposite the first component, in which the second component comprises a majority of the mass of the assembly to couple the assembly to the cochlea.

DETAILED DESCRIPTION OF THE INVENTION

As used herein light encompasses infrared light, visible light and ultraviolet light.

Embodiments of the present invention can be used with many users to transmit many sounds. Examples of people who can benefit from the hearing devices described herein include people with conductive hearing loss, sensorineural hearing loss and mixed hearing loss. For example, people with mixed hearing loss can benefit from improved hearing with stereo sound based on bone conduction and sound localization cues based bone conduction. People with sensorineural hearing loss can receive sound localization cues, for example with frequencies above 4 kHz. The devices described herein can be integrated with communications devices, for example for cell phone calls and entertainment, with people who have healthy hearing.

Figure 1:
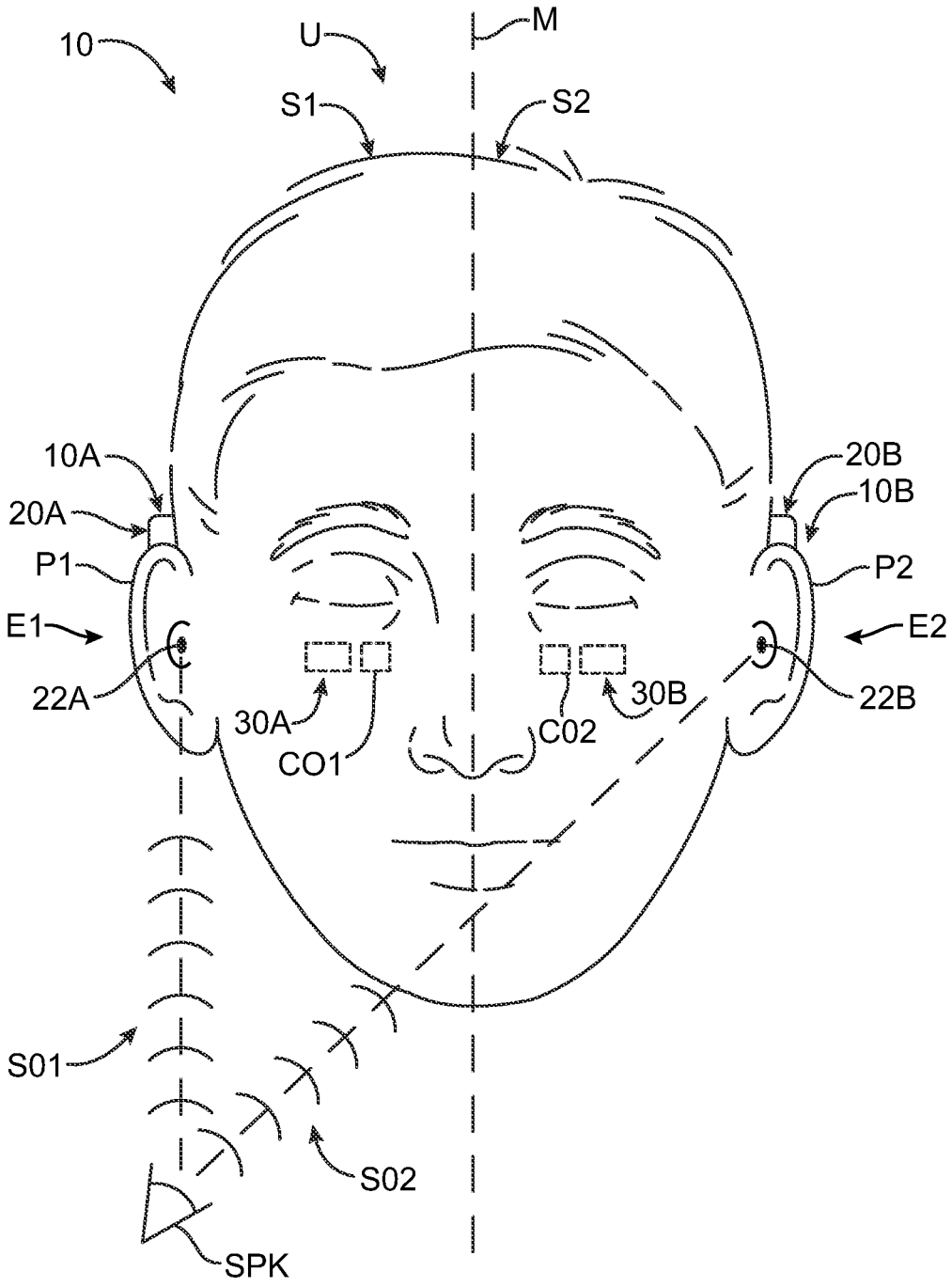
FIG. 1 shows a bone conduction hearing system configured to provide sound localization cues to the user.

FIG. 1 shows a bone conduction hearing system 10 configured to provide sound to a user U with bone vibration. The system 10 configured to provide stereo sound based on bone conduction and localization cues based on bone conduction. The user has a midline M, a first side S1 with a first ear E1, and a second side S2 with a second ear E2. Ear E1 has a first pinna P1 and ear E2 has a second pinna E2. The first side is disposed opposite the second side.

In many embodiments, hearing system 10 comprises a binaural hearing system a first hearing system 10A on first side S1 and a second hearing system 10B on a second side S2. However in some embodiments, the user may use only one hearing system, for example a user with one healthy hearing side and an opposite side having compromised hearing as with a congenital defect. First system 10A comprises a first input assembly 20A, and a first microphone 22A. The first input assembly may comprise a first behind the ear unit (hereinafter "BTE"), for example. First microphone 22A is shown positioned near a first ear canal opening of first ear E1. Second system 10B comprises a second input assembly 20B, and a second microphone 22B. The second input assembly may comprise second circuitry such as a BTE unit. The second microphone 22B is shown positioned near a second ear canal opening for second ear E2.

A first output transducer assembly 30A and a second output transducer assembly 30B are positioned on the first side S1 and second side S2, respectively, such that the user can localize sound to the first side S1 or the second side S2. First output transducer assembly 30A is positioned on side S1 near a first cochlea of the first side, and coupled to the first input transducer assembly. For example, the first output transducer assembly may be coupled to first mastoid bone or first cochlear bone of the first side of the user so as to vibrate the first cochlea CO1 on the first side with a first amount of energy. The acoustic vibration from the first output assembly can cross the midline M and vibrate the second cochlea CO2 with a second amount of energy. The tissue of the user disposed between the first output transducer assembly and the second cochlea can attenuate the acoustic vibration substantially, and the second amount of energy can be substantially less than the first amount of energy, for example at least about 6 dB, such that the user can localize the sound to the first side. Second output transducer assembly 30B is positioned on side S2 near a second cochlea of the second side, and coupled to the first second input transducer assembly. For example, the second output transducer assembly may be coupled to mastoid bone or cochlear bone of the user on the second side so as to vibrate the second cochlea CO2 on the second side with a third amount of energy. The acoustic vibration from the second output assembly can cross the midline M and vibrate the second cochlea CO2 with a fourth amount of energy. The tissue of the user disposed between the second output transducer assembly and the first cochlea can attenuate the acoustic vibration substantially, and the fourth amount of energy can be substantially less than the third amount of energy, for example at least about 6 dB, such that the user can localize the sound to the second side. With such a configuration, the user can perceive sounds in stereo.

In addition to providing localization of the sound to the first side or the second side, the first system 10A and the second system 10B can be configured to provide sound localization cues to the user, such that the user can localize the sound to a location within the first side or the second side. A speaker SPK is shown emitting a sound. The sound has a first path S01 to the first ear E1 and a second path S02 to the second ear E1. The first pinna can diffract the sound received on first path SO1 so as to provide first spatial localization cue with high frequencies, for example with frequencies above at least about 4 kHz. For example, the first system 10A can transmit sound frequencies within a range from about 60 Hz to at least about 15 kHz, for example up to 20 kHz or more. The second pinna can diffract the sound received on second path SO2 so as to provide second spatial localization cue with high frequencies, for example with frequencies above at least about 4 kHz. For example, the second system 10B can transmit sound frequencies within a range from about 60 Hz to at least about 15 kHz, for example up to 20 kHz or more. The embodiments as described herein can also provide sound localization through head shadowing, in which a sound pressure wave and corresponding signal from a microphone can be attenuated when the head of the person at least partially blocks the sound to the ear with the acoustic shadow of the head.

Figure 1A:
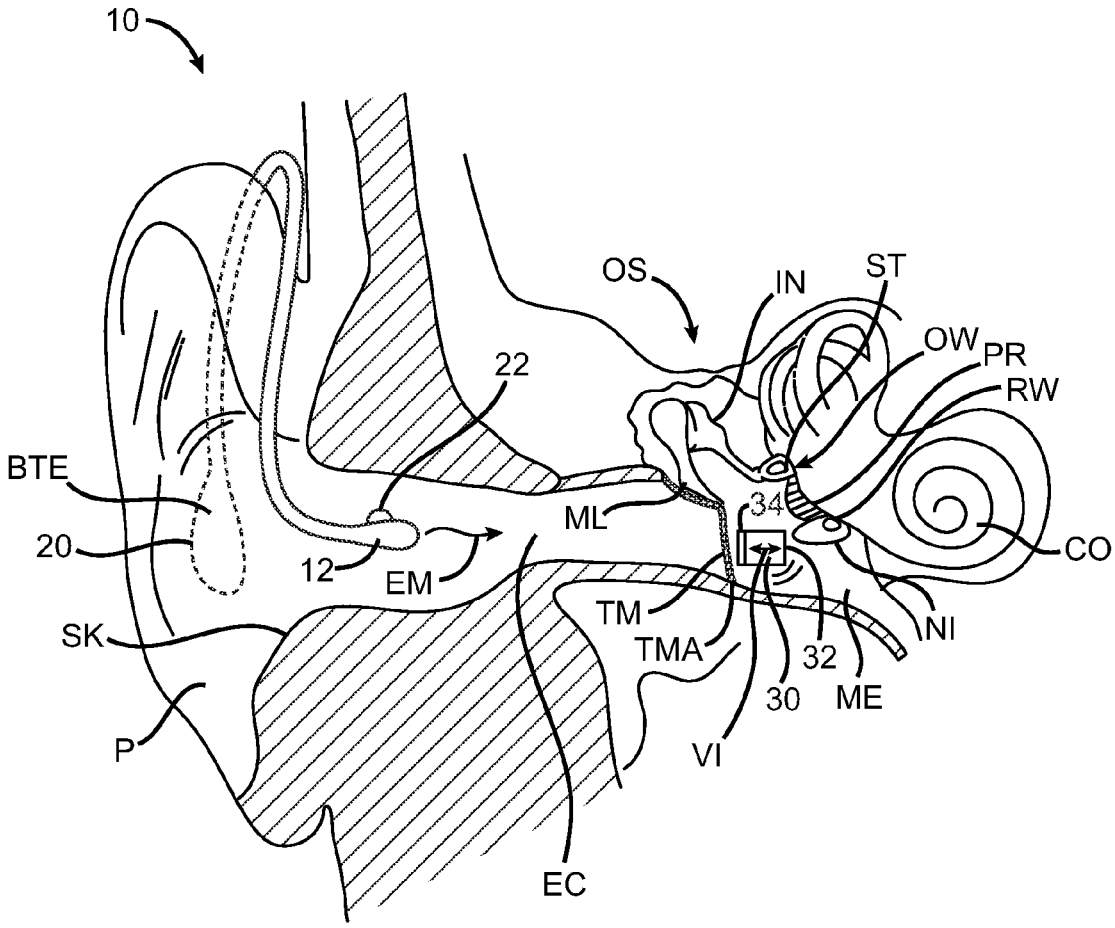
FIG. 1A shows an open canal hearing system, which may comprise components of first system or second system, in accordance with embodiments of the present invention.

FIG. 1A shows an open canal hearing system 10, which may comprise components of first system 10A or second system 10B. The hearing system 10 comprises an input assembly 20 and an output assembly 30. The input assembly 20 may comprise a behind the ear (hereinafter "BTE") unit. The output assembly 30 comprises a transducer 32 coupled to bone tissue to transmit the sound to the user.

In many embodiments, the hearing device comprises a photonic hearing device, in which sound is transmitted with photons having energy, such that the signal transmitted to the ear can be encoded with transmitted light.

Hearing system 10 is configured to transmit electromagnetic energy to an output transducer assembly 30 positioned in the middle ear ME of the user. The ear comprises an external ear, a middle ear ME and an inner ear. The external ear comprises a Pinna P and an ear canal EC and is bounded medially by an eardrum TM. Ear canal EC extends medially from pinna P to eardrum TM. Ear canal EC is at least partially defined by a skin SK disposed along the surface of the ear canal. The eardrum TM comprises an annulus TMA that extends circumferentially around a majority of the eardrum to hold the eardrum in place. The middle ear ME is disposed between eardrum TM of the ear and a cochlea CO of the ear. The middle ear ME comprises the ossicles OS to couple the eardrum TM to cochlea CO. The ossicles OS comprise an incus IN, a malleus ML and a stapes ST. The malleus ML is connected to the eardrum TM and the stapes ST is connected to an oval window OW, with the incus IN disposed between the malleus ML and stapes ST. Stapes ST is coupled to the oval window OW so as to conduct sound from the middle ear to the cochlea.

The hearing system 10 includes an input transducer assembly 20 and an output transducer assembly 30 to transmit sound to the user. The BTE unit may comprise many components of system 10 such as a speech processor, battery, wireless transmission circuitry and input transducer assembly 10. Behind the ear unit BTE may comprise many component as described in U.S. Pat. Pub. Nos. 2007/0100197, entitled "Output transducers for hearing systems"; and 2006/0251278, entitled "Hearing system having improved high frequency response", the full disclosures of which are incorporated herein by reference and may be suitable for combination in accordance with some embodiments of the present invention. The input transducer assembly 20 can be located at least partially behind the pinna P, although the input transducer assembly may be located at many sites. For example, the input transducer assembly may be located substantially within the ear canal, as described in U.S. Pub. No. 2006/0251278, the full disclosure of which is incorporated by reference. The input transducer assembly may comprise a blue tooth connection to couple to a cell phone and my comprise, for example, components of the commercially available Sound ID 300, available from Sound ID of Palo Alto, Calif.

The input transducer assembly 20 can receive a sound input, for example an audio sound. With hearing aids for hearing impaired individuals, the input can be ambient sound. The input transducer assembly comprises at least one input transducer, for example a microphone 22. Microphone 22 can be positioned in many locations such as behind the ear, as appropriate. Microphone 22 is shown positioned to detect spatial localization cues from the ambient sound, such that the user can determine where a speaker is located based on the transmitted sound. The pinna P of the ear can diffract sound waves toward the ear canal opening such that sound localization cues can be detected with frequencies above at least about 4 kHz. The sound localization cues can be detected when the microphone is positioned within ear canal EC and also when the microphone is positioned outside the ear canal EC and within about 5 mm of the ear canal opening. The at least one input transducer may comprise a second microphone located away from the ear canal and the ear canal opening, for example positioned on the behind the ear unit BTE. The input transducer assembly can include a suitable amplifier or other electronic interface. In some embodiments, the input may comprise an electronic sound signal from a sound producing or receiving device, such as a telephone, a cellular telephone, a Bluetooth connection, a radio, a digital audio unit, and the like.

In many embodiments, at least a first microphone can be positioned in an ear canal or near an opening of the ear canal to measure high frequency sound above at least about one 4 kHz comprising spatial localization cues. A second microphone can be positioned away from the ear canal and the ear canal opening to measure at least low frequency sound below about 4 kHz. This configuration may decrease feedback to the user, as described in U.S. Pat. Pub. No. US 2009/0097681, the full disclosure of which is incorporated herein by reference and may be suitable for combination in accordance with embodiments of the present invention.

Input transducer assembly 20 includes a signal output source 12 which may comprise a light source such as an LED or a laser diode, an electromagnet, an RF source, or the like. The signal output source can produce an output based on the sound input. Implantable output transducer assembly 30 can receive the output from input transducer assembly 20 and can produce mechanical vibrations in response. Implantable output transducer assembly 30 comprises a transducer and may comprise at least one of a coil, a magnet, a balanced armature, a magnetostrictive element, a photostrictive element, or a piezoelectric element, for example. For example, the implantable output transducer assembly 30 can be coupled an input transducer assembly 20 comprising an elongate flexible support having a coil supported thereon for insertion into the ear canal as described in U.S. Pat. Pub. No. 2009/0092271, entitled "Energy Delivery and Microphone Placement Methods for Improved Comfort in an Open Canal Hearing Aid", the full disclosure of which is incorporated herein by reference and may be suitable for combination in accordance with some embodiments of the present invention. Alternatively or in combination, the input transducer assembly 20 may comprise a light source coupled to a fiber optic, for example as described in U.S. Pat. Pub. No. 2006/0189841 entitled, "Systems and Methods for Photo-Mechanical Hearing Transduction", the full disclosure of which is incorporated herein by reference and may be suitable for combination in accordance with some embodiments of the present invention. The light source of the input transducer assembly 20 may also be positioned in the ear canal, and the output transducer assembly and the BTE circuitry components may be located within the ear canal so as to fit within the ear canal. When properly coupled to the subject's hearing transduction pathway, the mechanical vibrations caused by output transducer 30 can induce neural impulses in the subject which can be interpreted by the subject as the original sound input.

The implantable output transducer assembly 30 can be configured to couple to the cochlea of the inner ear in many ways, so as to induce neural impulses which can be interpreted as sound by the user. The coupling may occur with at least a portion of the transducer coupled to bone, for example affixed to bone, such that the vibration originates near the cochlea such that sound transmitted to a second cochlea is inhibited substantially by tissue as described above. The implantable output transducer assembly 30 can be supported with a substantially fixed structure of the ear, such that vibration of the vibratory structures of the ear is not inhibited by mass of assembly 30. For example, output transducer assembly 30 may be supported on the promontory PM by a support, housing, mold, or the like shaped to conform with the shape of the promontory PM. The transducer assembly may be affixed with a tissue graft to skin supported with rigid bony structure that defines at least a portion of the ear canal. The transducer assembly 30 can be supported with many of the additional substantially fixed structures of the middle ear such as the bone that defines the round window niche.

As the pressure intensity of sound transmitted from a source coupled to bone can decrease with distance from the source, the transducer can be coupled to one or more of many locations of the temporal bone tissue, for example on the cochlear bone tissue. For example, the sound pressure intensity can be proportional to the inverse of the distance, or the inverse square of the distance, and inverse exponential powers there between. The amount of attenuation can increase with frequency, such that higher frequency sounds may provide greater discrimination than lower frequency sounds. Transcranial attenuation of the cochlea increases for frequencies above about 2 kHz, which allows the user to localize sound. Consequently, positioning the transducer near the corresponding cochlea away from the other cochlea can increase discrimination of the sound from the transducer and increase corresponding spatial localization cues and head shadow cues at many frequencies, for example above about 2 kHz. The cochleae of a patient can be separated by distance, and the transducer for each cochlea can be positioned a distance from the corresponding cochlea of no more than about the separation distance of the cochleae, for example no more than about one half of the separation distance. For example, the cochleae can be separated by a distance of about 50 mm, and the sound transducer can be positioned within about 25 mm of the corresponding cochlea and located away from the other cochlea.

FIG. 1A1 shows an input assembly 20 of system 10 comprising an ear canal module (hereinafter "ECM"). The ECM may comprise many of the components of the BTE unit and vice-versa. The ECM may be shaped from a mold of the user's ear canal EC. Circuitry (Circ.) can be coupled to microphone 22. The circuitry may comprise a sound processor. The ECM may comprise an energy storage device PS configured to store electrical energy. The storage device may comprise many known storage devices such at least one of a battery, a rechargeable batter, a capacitor, a supercapacitor, or electrochemical double layer capacitor (EDLC). The ECM can be removed, for example for recharging or when the user sleeps. The ECM may comprise a channel 29 to pass air so as to decrease occlusion. Although air is passed through channel 29, feedback can be decrease due to coupling of the transducer or electrode array directly to tissue.

The energy storage device PS may comprise a rechargeable energy storage device that can be recharged in many ways. For example, the energy storage device may be charged with a plug in connector coupled to a super capacitor for rapid charging. Alternatively, the energy storage device may be charged with an inductive coil or with a photodetector PV. The photodetector detector PV may be positioned on a proximal end of the ECM such that the photodetector is exposed to light entering the ear canal EC. The photodetector PV can be coupled to the energy storage device PS so as to charge the energy storage device PS. The photodetector may comprise many detectors, for example black silicone as described above. The rechargeable energy storage device can be provided merely for convenience, as the energy storage device PS may comprise batteries that the user can replace when the ECM is removed from ear canal.

The photodetector PV may comprise at least one photovoltaic material such as crystalline silicon, amorphous silicon, micromorphous silicon, black silicon, cadmium telluride, copper indium gallium selenide, and the like. In some embodiments, the photodetector PV may comprise black silicon, for example as described in U.S. Pat. Nos. 7,354,792 and 7,390,689 and available under from SiOnyx, Inc. of Beverly, Mass. The black silicon may comprise shallow junction photonics manufactured with semiconductor process that exploits atomic level alterations that occur in materials irradiated by high intensity lasers, such as a femto-second laser that exposes the target semiconductor to high intensity pulses as short as one billionth of a millionth of a second. Crystalline materials subject to these intense localized energy events may under go a transformative change, such that the atomic structure becomes instantaneously disordered and new compounds are "locked in" as the substrate re-crystallizes. When applied to silicon, the result can be a highly doped, optically opaque, shallow junction interface that is many times more sensitive to light than conventional semiconductor materials. Photovoltaic transducers for hearing devices are also described in detail in U.S. Patent Applications Nos. 61/073,271, entitled "Optical Electro-Mechanical Hearing Devices With Combined Power and Signal Architectures"; and 61/073,281, entitled "Optical Electro-Mechanical Hearing Devices with Separate Power and Signal", the full disclosures of which have been previously incorporated herein by reference and may be suitable for combination in accordance with some embodiments as described herein.

The output transducer assembly and anchor structure can be shaped in many ways to fit within the middle ear during implantation and affix to structures therein to couple to the cochlea. For example, the output transducer assembly may comprise a cross sectional size to pass through an incision in the eardrum TM and annulus TMA, such that bone that defines the ear canal can remain intact. The annulus TMA can be supported by a sulcus SU formed in the bony portion of the ear disposed between the external ear and middle ear. The eardrum can be incised along the annulus to form a flap of eardrum, a portion of which eardrum may remain connected to the user and placed on the margin of the ear canal when the transducer assembly 30 is positioned in the middle ear. Flap can be positioned after the transducer is positioned in the middle ear. The transducer assembly may comprise at least a portion shaped to fit within a round window niche.

The anchor structure can be configured to attach to many structures of the middle ear. For example, the anchor structure can be configured to affix to bone of the promontory. Alternatively or in combination, the anchor structure may be configured to couple to a bony lip near the round window, or the anchor structure can be configured to anchor in the inferior portion of the middle ear cavity.

The BTE may comprise many of the components of the ECM, for example photodetector PV, energy storage device PS, the processor and circuitry, as described above.

Figure 1B:
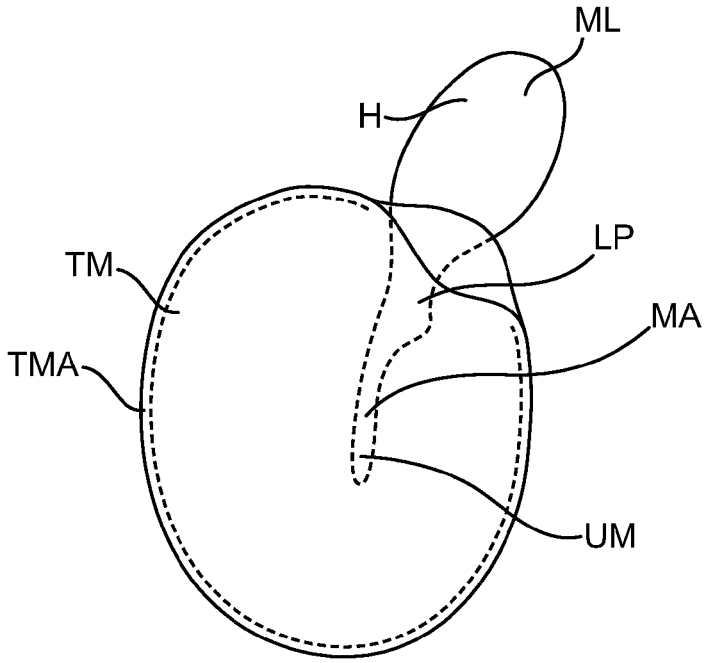
FIG. 1B shows the lateral side of the eardrum and FIG. 1C shows the medial side of the eardrum, suitable for incorporation of the hearing aid system of FIG. 1.
Figure 1C:
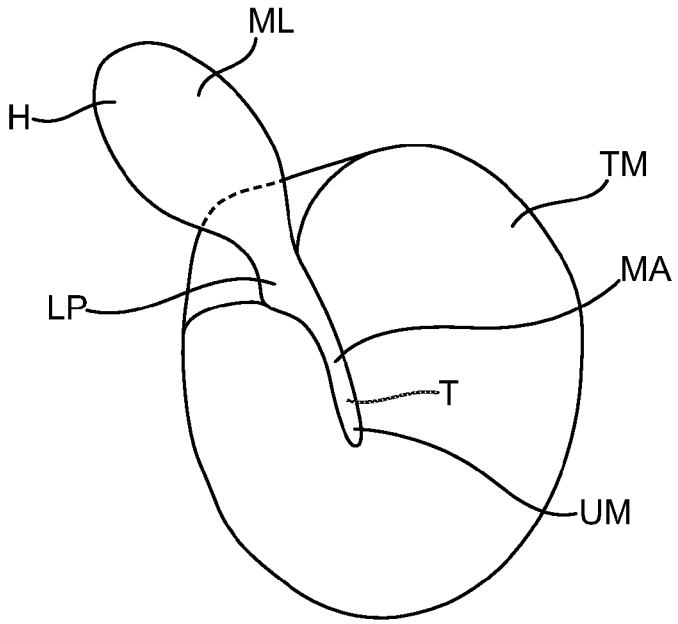

FIG. 1B shows the lateral side of the eardrum and FIG. 1C shows the medial side of the eardrum, suitable for access to the middle ear for implantation of the output assembly of the hearing system of FIGS. 1A and 1A1. The eardrum TM is connected to a malleus ML. Malleus ML comprises a head H, a manubrium MA, a lateral process LP, and a tip T. Manubrium MA is disposed between head H and tip T and coupled to eardrum TM, such that the malleus ML vibrates with vibration of eardrum TM. An incision can be made in the eardrum to insert the output assembly in the middle ear and bone tissue.

Figure 1D:
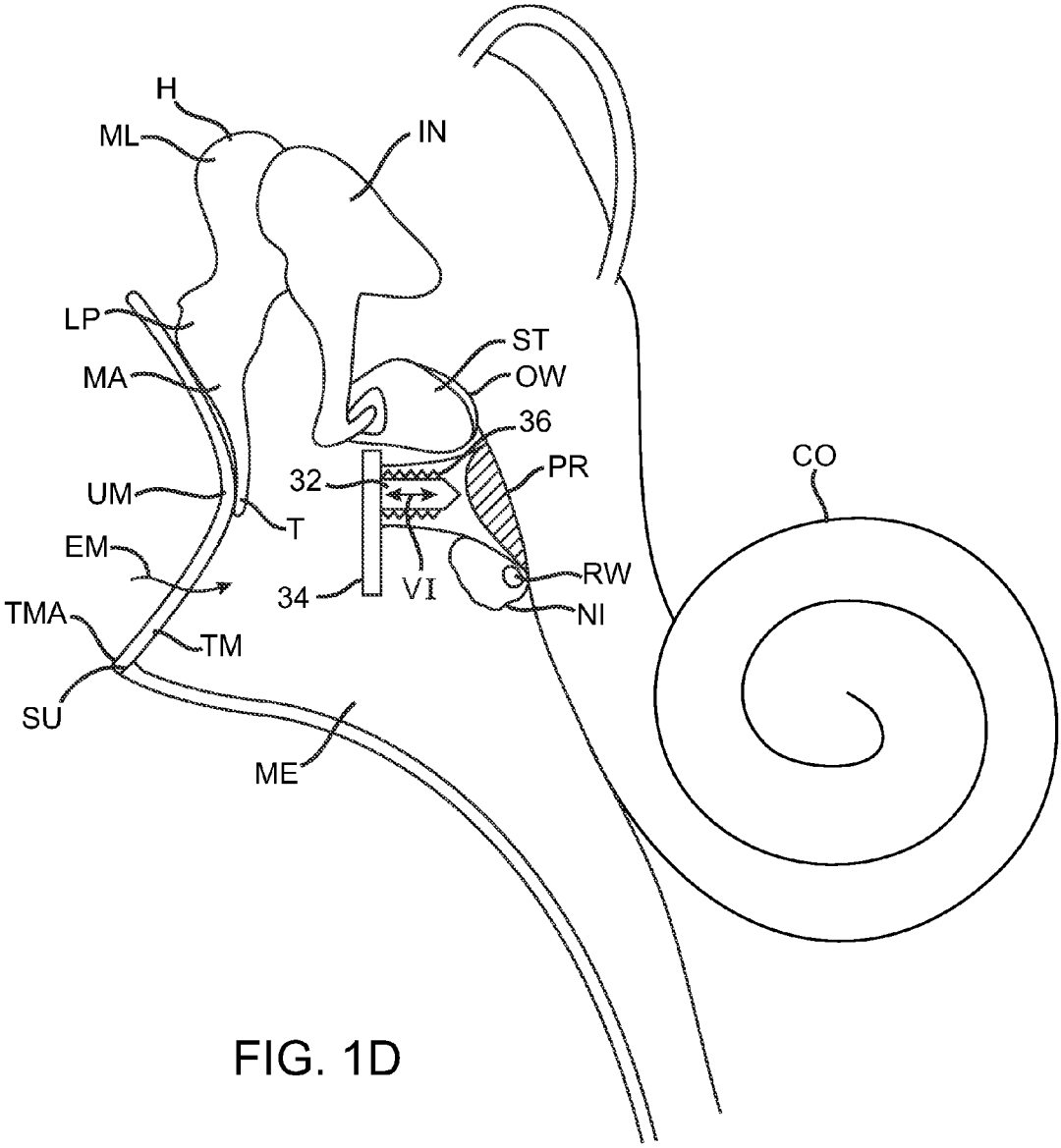
FIG. 1D shows the output transducer assembly affixed to the promontory disposed on an inner surface of the cavity of the middle ear ME, such that the user can perceive sound.

FIG. 1D shows the output transducer assembly 30 affixed to the promontory disposed on an inner surface of the cavity of the middle ear ME, such that the user can perceive sound. Output transducer assembly 30 comprises an output transducer 32. Output transducer 32 vibrates the bone tissue of the cochlea such that sound is perceived by the user. The output transducer assembly also comprises at least one transducer 34 configured to receive electromagnetic energy transmitted through the eardrum TM, for example at least one of a coil, a photodetector, or a photostrictive material. The at least one transducer 34 may be coupled to the output transducer 32 with circuitry 38, such that output transducer 32 vibrates in response to electromagnetic energy transmitted through eardrum TM. Output transducer assembly 30 may comprise an anchor structure 36 configured to affix the output transducer assembly to a substantially fixed structure of the ear, such as promontory PR. The anchor structure 36 may comprise a biocompatible structure configured to receive a tissue graft, for example, and may comprise at least one of a coating, a flange or holes for tissue integration. The anchor structure 36 can be affixed to the bone tissue such that the location of the assembly remains substantially fixed when sound transducer 32 is acoustically coupled to the vibratory structures of the ear. For example, a small hole can be drilled in the promontory PR and the anchor screwed into the hole to couple to the cochlear bone.

In some embodiments, the at least one detector 34 may comprise output transducer 32. For example the photodetector may comprise a photostrictive material configured to vibrate in response to light energy.

Figure 1E:
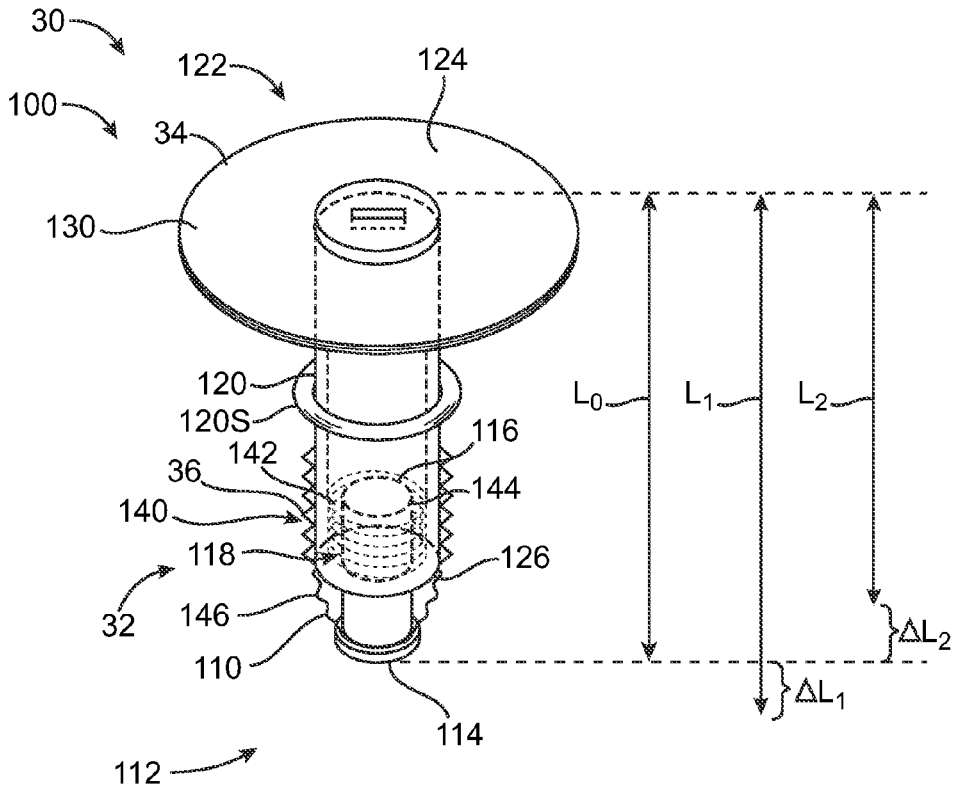
FIGS. 1E and 1F show a schematic illustration and side cross sectional view, respectively, of output transducer assembly 30 as in FIGS. 1A and 1A1.
Figure 1F:
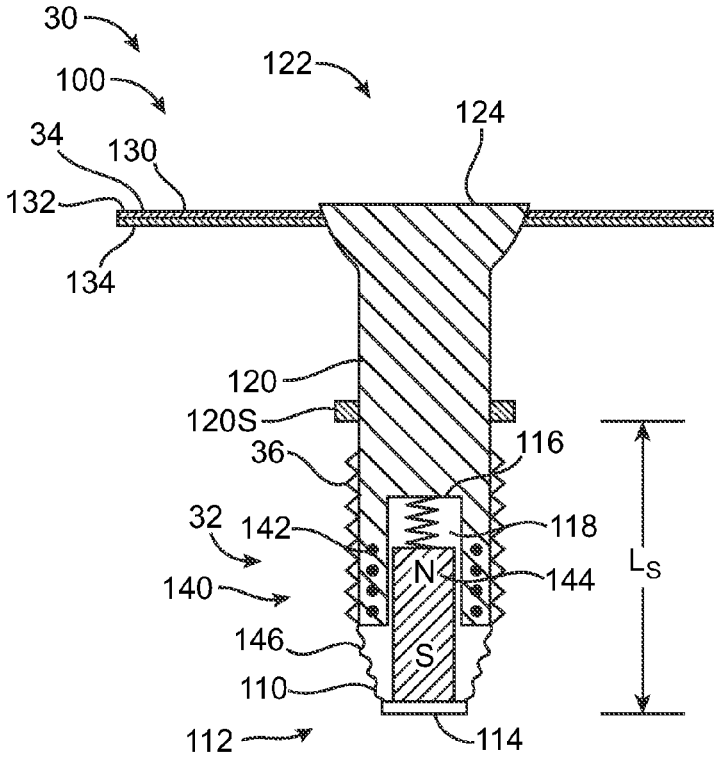

FIGS. 1E and 1F show a schematic illustration and side cross sectional view, respectively, of output transducer assembly 30 as in FIGS. 1A and 1A1 in accordance with embodiments. The output transducer assembly 30 may comprise a variable length assembly 100. Assembly 100 may comprise a medial component 110 configured to couple to the promontory and a lateral component 120 configured to comprise a mass opposite the medial component to direct the vibration energy toward the cochlea. The medial component may have a first end portion 112 comprising a recess 114 formed thereon, and a second end 116 portion disposed opposite the first end portion. The lateral component 120 may comprise a first end portion 122 having a recess 124 formed thereon and a second end portion 126 disposed opposite the first end portion. A movement transducer 140 can be disposed between the medial component 110 and the lateral component 120. Movement transducer 140 can be coupled to a transducer 130 configured to receive electromagnetic energy. An electrical conductor, for example a wire, can extend between transducer 130 and movement transducer 140. Transducer 130 may comprise a coil, for example. Alternatively or in combination, transducer 130 may comprise at least one photodetector configured to drive movement transducer 140 in response to light signals transmitted through the eardrum. Transducer 140 is configured to vary a length Lo extending between end 114 and end 124, such that the cochlear bone vibrates in response to the electromagnetic energy. Transducer 140 may comprise a telescopic joint, in which a portion of the medial component slides inside a channel formed in the lateral component. For example, the length between end 114 and end 124 can increase from Lo to L1 and decrease to length L2, such that the cochlear bone tissue vibrates. The lateral component 120 may comprise a greater mass than medial component 110, such that medial component 110 opposes the lateral component 120. This coupling can decrease feedback to microphone 22, as the cochlea CO can be vibrated a relatively greater amount than eardrum TM. The transducer 130 can be affixed to the lateral component 120 and the lateral component may comprise the transducer 130 such that the lateral component comprises at least about twice the mass of the medial component, for example at least about four times the mass of the medial component. A spring structure 118 may be coupled to the lateral component and the medial component to couple the lateral component to the medial component, and the spring 118 can be tuned with the lateral component and the medial component to a frequency response. The spring structure may be compressed when the assembly 100 is installed, and can also provide safety, for example when the assembly is pressed medially. The spring structure 118 may comprise many kinds of springs and may comprise an elastic material, for example an elastomer. The spring structure may comprise one or more of many shapes such as spiral, helical, leaf, circular, O-ring or ball shapes, for example.

The assembly 100 can be sized to the user in many ways. For example, the surgeon can measure the middle ear of the user, and select the assembly 100 from among a plurality of assemblies based on the measurement of the user's ear and the length Lo. The length Lo of the assembly may comprise a length when no electromagnetic energy is transmitted to induce vibration.

Variable length assembly 100 can be configured with at least one transducer in many ways so as to vibrate the cochlea CO such that the user perceives sound. For example, the at least one transducer may comprise movement transducer 140 comprising at least one of a piezoelectric transducer, a coil, a magnet, a balanced armature transducer, photostrictive material or a magnetostrictive material. The movement transducer can be positioned to couple to the lateral component and the medial component, for example between the two, such that the movement transducer can vary the length between the ends. For example, a photostrictive material can be disposed between the lateral component and the medial component and can extend outward similar to transducer 130 so as to receive light energy transmitted through eardrum TM. The movement transducer 140 may comprise a coil 142 affixed to the lateral component, and a magnet 144 positioned within coil 142. Alternatively, the lateral component may comprise the magnet and the medial component may comprise the coil. The assembly 100 may comprise a housing, and the housing may comprise a bellows 146 to allow the medial component 110 to slide relative to lateral component 120. The movement transducer 140 may comprise a coupling structure, for example a spring 118 or an elastomer, so as to couple the medial component 110 to lateral component 120 in the passive mode. The bellows may also be configured to coupled the medial component with the lateral component. The coupling structure may also comprise a tuning structure so as to provide a desired transfer function of the coupling of the medial component to the lateral component. The coupling structure can be used to tune the passive coupling and the active coupling of the lateral component to the medial component.

The transducer 130 may comprise at least one photodetector as noted above. For example, the at least one photodetector may comprise a first photodetector 132 and a second photodetector 134. The first photodetector 132 can be sensitive to a first at least one wavelength of light, and the second photodetector 134 can be sensitive to a second at least one wavelength of light. The first photodetector may transmit substantially the second at least one wavelength of light such that the first photodetector can be positioned over the second photodetector. The first photodetector 132 and the second photodetector 134 may be coupled to the movement transducer 140 with an opposite polarity such that the transducer urges the first component toward the second component so as to decrease the length in response to the first at least one wavelength of light and such that the transducer urges the first component away from the second component so as to increase the length in response to the second at least one wavelength of light.

The first light output signal and the second light output signal can drive the movement transducer in a first direction and a second direction, respectively, such that the cross sectional size of both detectors positioned on the assembly corresponds to a size of one of the detectors. The first detector may be sensitive to light comprising at least one wavelength of about 1 um, and the second detector can be sensitive to light comprising at least one wavelength of about 1.5 um. The first detector may comprise a silicon (hereinafter "Si") detector configured to absorb substantially light having wavelengths from about 700 to about 1100 nm, and configured to transmit substantially light having wavelengths from about 1400 to about 1700 nm, for example from about 1500 to about 1600 nm. For example, the first detector can be configured to absorb substantially light at 904 nm. The second detector may comprise an Indium Galium Arsenide detector (hereinafter "InGaAs") configured to absorb light transmitted through the first detector and having wavelengths from about 1400 to about 1700 nm, for example from about 1500 to 1600 nm, for example 1550 nm. In a specific example, the second detector can be configured to absorb light at about 1310 nm. The cross sectional area of the detectors can be about 4 mm squared, for example a 2 mm by 2 mm square for each detector, such that the total detection area of 8 mm squared exceeds the cross sectional area of 4 mm squared of the detectors in the ear canal. The detectors may comprise circular detection areas, for example a 2 mm diameter circular detector area.

The first photodetector 132 and the second photodetector 134 may comprise at least one photovoltaic material such as crystalline silicon, amorphous silicon, micromorphous silicon, black silicon, cadmium telluride, copper indium gallium selenide, and the like. In some embodiments, at least one of photodetector 132 or photodetector 132 may comprise black silicon, for example as described in U.S. Pat. Nos. 7,354,792 and 7,390,689 and available under from SiOnyx, Inc. of Beverly, Mass. The black silicon may comprise shallow junction photonics manufactured with semiconductor process that exploits atomic level alterations that occur in materials irradiated by high intensity lasers, such as a femto-second laser that exposes the target semiconductor to high intensity pulses as short as one billionth of a millionth of a second. Crystalline materials subject to these intense localized energy events may under go a transformative change, such that the atomic structure becomes instantaneously disordered and new compounds are "locked in" as the substrate re-crystallizes. When applied to silicon, the result can be a highly doped, optically opaque, shallow junction interface that is many times more sensitive to light than conventional semiconductor materials. Photovoltaic transducers for hearing devices are also described in detail in U.S. patent application Ser. No. 12/486,100, filed Jun. 17, 2009, entitled "Optical Electro-Mechanical Hearing Devices With Combined Power and Signal Architectures"; and Ser. No. 12/486,116, filed Jun. 17, 2009, entitled "Optical Electro-Mechanical Hearing Devices with Separate Power and Signal", the full disclosures of which are incorporated herein by reference and may be suitable for combination in accordance with some embodiments as described herein.

The electromagnetic signal transmitted through the eardrum TM to the assembly 100 may comprise one or more of many kinds of signals. For example, the signal transmitted through the eardrum TM may comprise a pulse width modulated signal. The pulse width modulated signal may comprise a first pulse width modulated signal of at least one first wavelength of light from a first source and the second pulse width modulated signal of a second at least one wavelength of light from a second source. The first at least one wavelength of light may be received by a first detector, and the second at least one wavelength of light may be received by the second detector.

The first end 112 can be shaped in many ways to couple to the cochlear bone tissue. The first end 112 can be configured to advance into a channel formed in the promontory. The first end 112 may comprise a flat surface to contact the bone at the end of the channel. The anchor 36 may comprise threads to advance the output assembly. A stop 120S can be located at distance Ls from the end so as to limit penetration of the distal end to a predetermined depth, for example a predetermined depth within a range from 0.5 to 3 mm, so as to avoid penetrating and/or fracturing the cochlear bone.

The components of the output assembly 30 may comprise many biocompatible materials, for example hydroxyapatite, titanium, polymer, or cobalt chrome, and many combinations thereof. The biocompatible material may comprise a material to promote bone growth. For example, the first end 112 may comprise hydroxyapatite and the second end 122 may comprise hydroxyapatite.

FIG. 1E1 shows a variable length assembly comprising a first component configured to affix to cochlear bone tissue and a second component configured to move opposite the first component, in which the second component comprises a majority of the mass of the assembly to couple the assembly to the cochlea. The assembly comprises many of the components noted above with reference to FIGS. 1E and 1F. The anchor 36 and stop 120S may be located on medial component 110, for example, to limit penetration of the medial component to a predetermined depth as noted above. The lateral component may comprise a majority of the mass of the assembly as noted above.

Figure 1G:
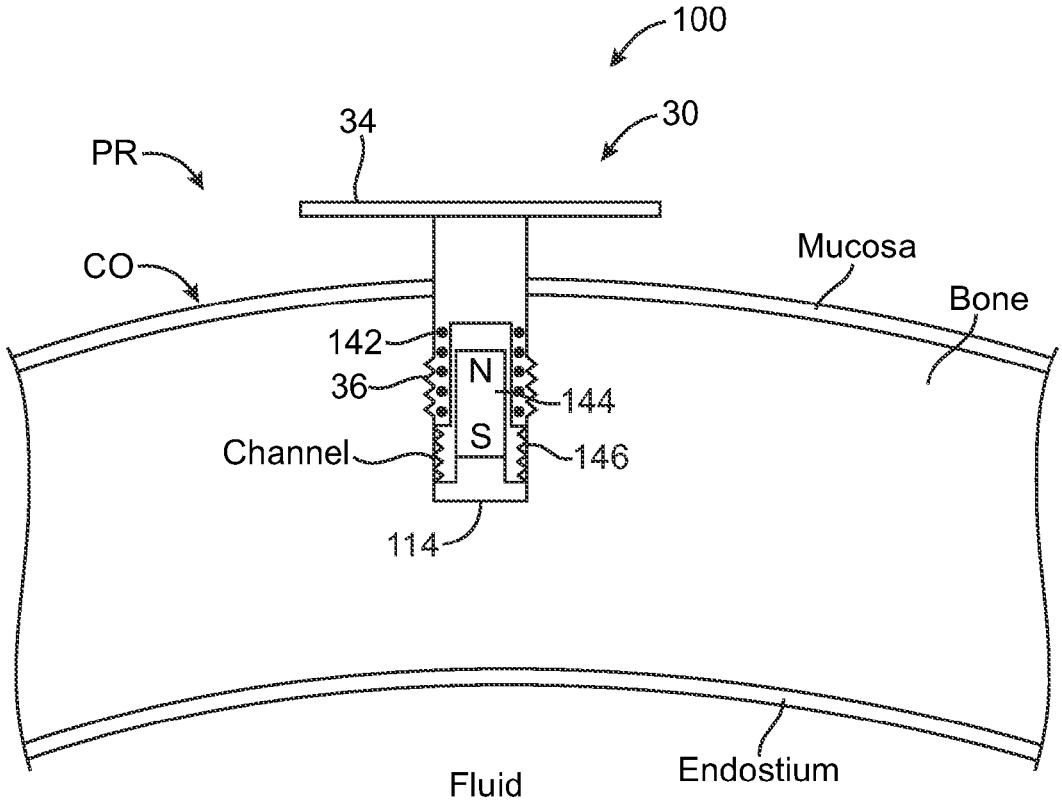
FIG. 1G shows a schematic illustration of the output transducer assembly as in FIGS. 1 to 1F implanted at least partially into the cochlear bone tissue of the user, in accordance with embodiments of the present invention.

FIG. 1G shows a schematic illustration of the output transducer assembly 30 implanted at least partially into the cochlear bone tissue of the user. The second end 114 can extend into the cochlear bone a distance within a range from about 0.5 to 3 mm. A mucosa can be located over the bone, and the light energy can be transmitted through mucosa that may migrate over the light detector, for example. An endostium is located over an inner surface of the cochlear bone so as to contain a fluid of the cochlea. The proximity of the end to the fluid of the cochlea to the assembly 30 can efficiently transfer vibration energy to the cochlea and decrease coupling of the transducer assembly 30 to the second cochlea of the user disposed on a opposite side of the user, such that sound can be localized to a side of the user, and sound localization cues can be provided to the user with frequencies above at least about 4 kHz as noted above, for example from at least about 4 kHz to 15 kHz, for example up to 20 kHz.

Many of the embodiments as described herein can be implanted at least partially into the bone. For example the fixed length output transducer assembly or the variable length output transducer assembly can be implanted at least partially into the bone.

Figure 1H:
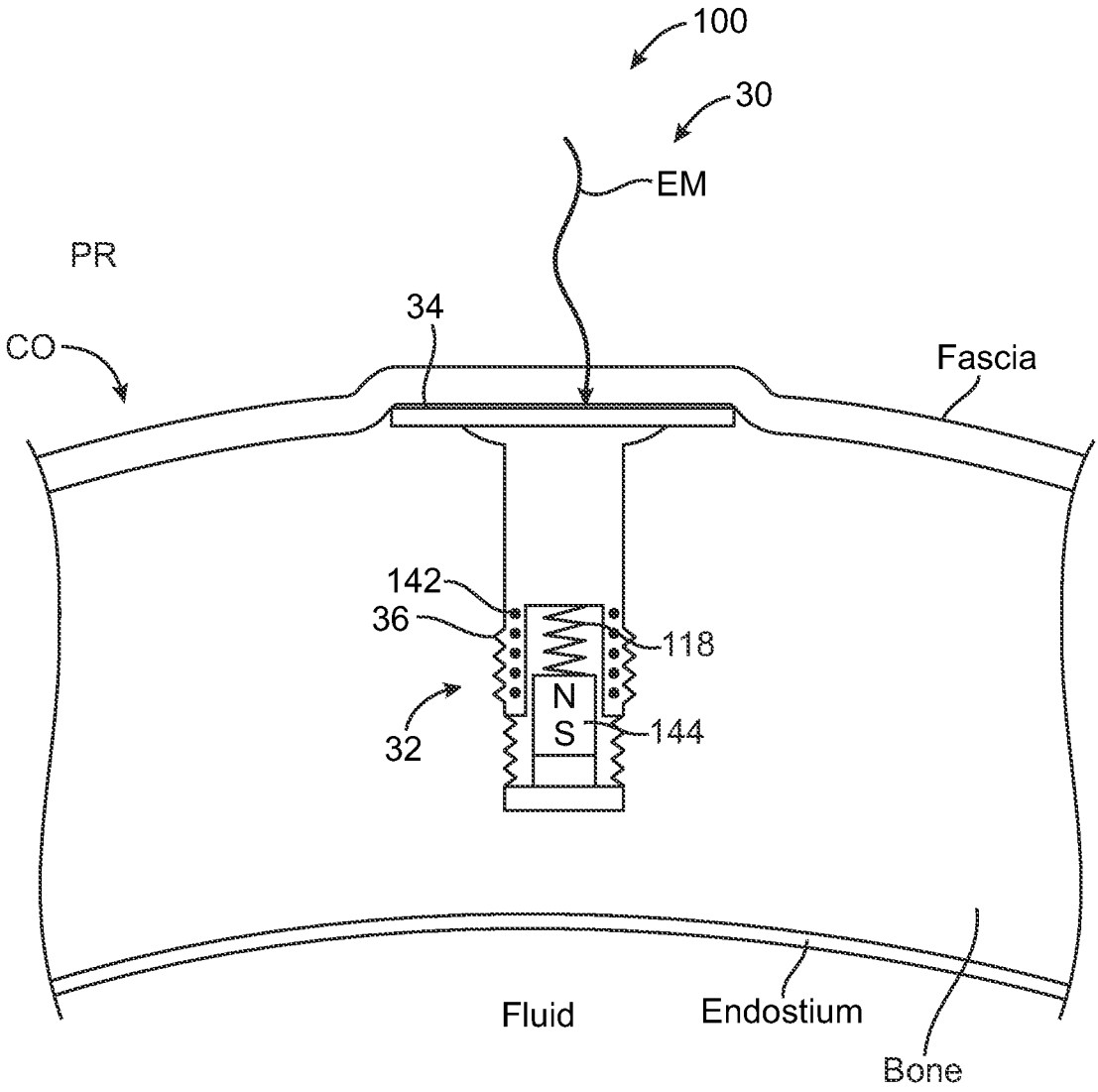
FIG. 1H shows a schematic illustration of the output transducer assembly as in FIGS. 1 to 1F implanted at least partially into the cochlear bone tissue of the user with fascia disposed over the at least one detector configured to receive electromagnetic energy, in accordance with embodiments of the present invention.

FIG. 1H shows a schematic illustration of the output transducer assembly 30 implanted at least partially into the cochlear bone tissue of the user with fascia disposed over the at least one detector configured to receive electromagnetic energy. The electromagnetic energy may comprise magnetic energy from a coil, or light energy as noted above. Light energy can be transmitted through the fascia FA and may be simultaneously transmitted through mucosa that may deposit on the fascia and/or light energy detector.

Many of the embodiments as described herein can be implanted at least partially into the bone with fascia disposed over the at least one detector, such as a photodetector comprising a photovoltaic. For example, the fixed length output transducer assembly or the variable length output transducer assembly can be implanted at least partially into the bone with fascia disposed over the at least one detector.

Figure 2A:
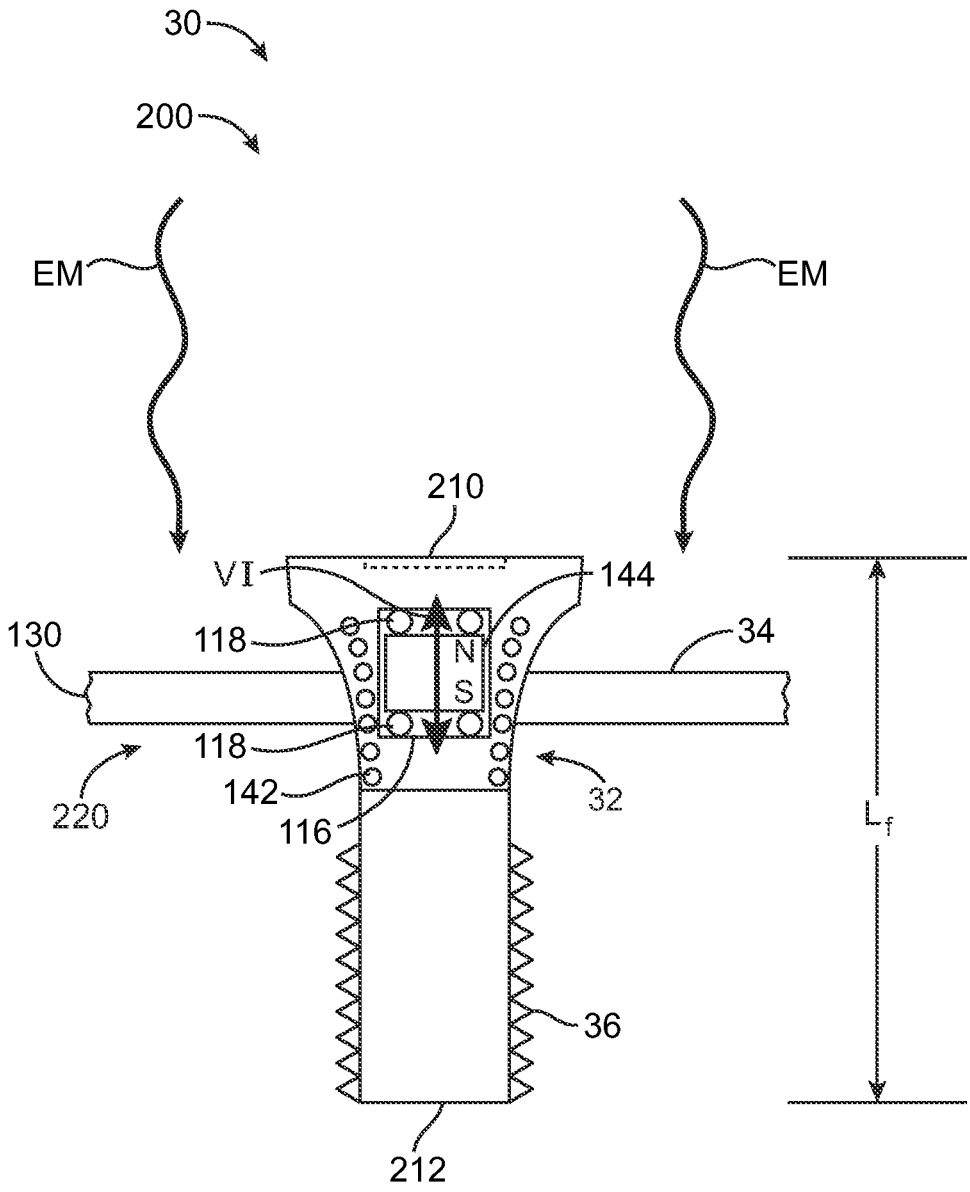
FIG. 2A shows a schematic illustration of a fixed length output assembly, in accordance with embodiments.

FIG. 2A shows a schematic illustration of a fixed length output transducer assembly 200. The output transducer assembly 30 may comprise a fixed length assembly 200, comprising a substantially rigid material extending from the first end to the second end. The fixed length output transducer assembly 200 can be configured with at least one transducer in many ways so as to vibrated the cochlea CO such that the user perceives sound. The magnet may comprise an internal mass that moves in opposition to the anchor 36, such that vibration is transmitted to the cochlear tissue of the user and perceived as sound. An internal channel can be sized so as to allow the magnet to move vertically in response to the magnetic field from the coil.

A distance from the first end to the second end is within a range from about 2.5 mm to about 7 such that the assembly can be coupled to the cochlear bone. The distance from the first end to the second end can be sized based on the characteristics of the user, for example based on in situ measurement during surgery, such that an appropriately sized device can be selected from among a plurality of incrementally sized devices available to the surgeon as noted above.

The assembly 200 may comprise a rigid material extending from the lateral end to the medial end, and may comprise one or more of many biocompatible materials, for example hydroxyapatite, titanium, polymer, cobalt chrome, and many combinations thereof. The assembly 200 may comprise a substantially constant length. The lateral end 210 and medial end 212 of assembly 200 may vibrate together and in opposition to an internal mass of the at least one transducer 220, for example in opposition to an internal mass comprising the magnet as described above, such that the user perceives sound.

Figure 2B:
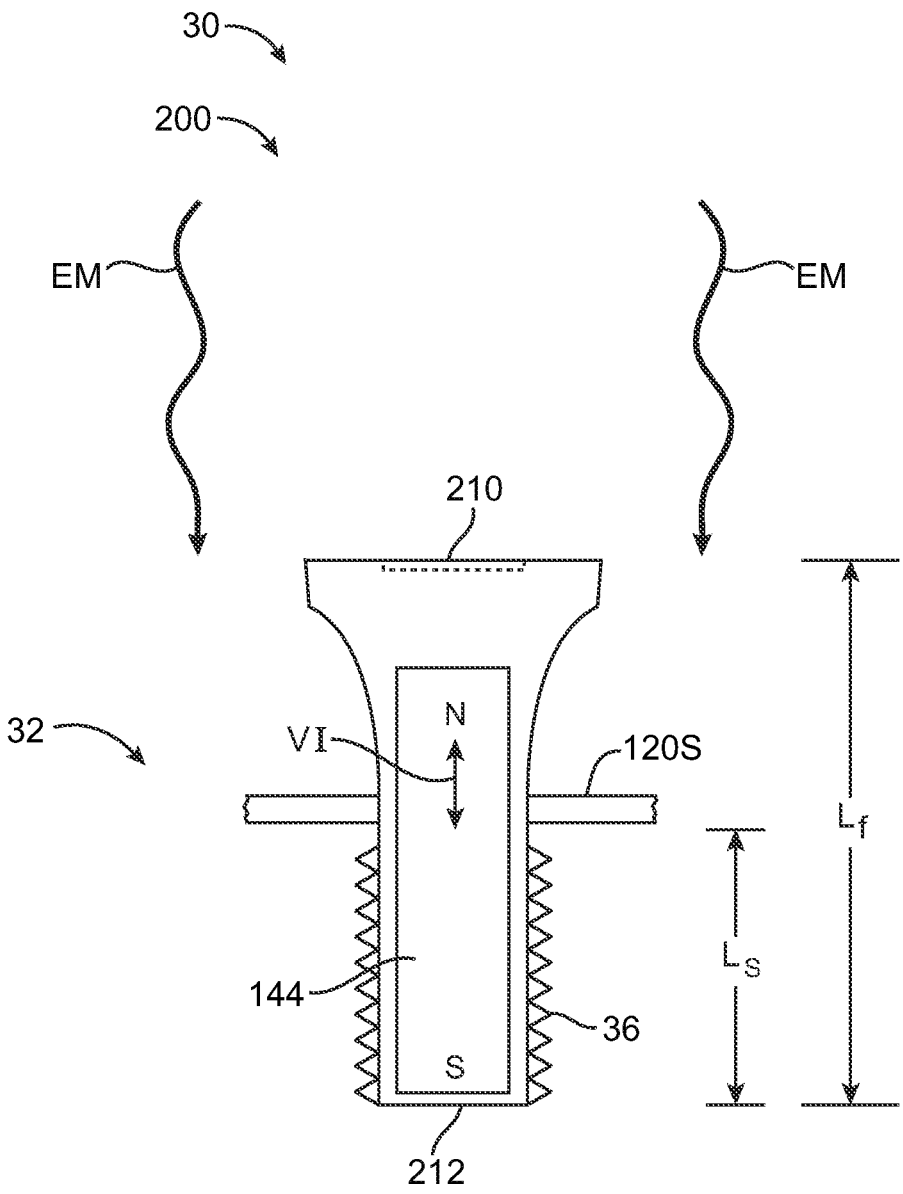
FIG. 2B shows a schematic illustration of a fixed length output assembly configured to couple to a coil positioned in the ear canal of the user, in accordance with embodiments.

FIG. 2B shows a schematic illustration of a fixed length output assembly 200 configured to couple to a coil positioned in the ear canal of the user. The output assembly 200 may comprise magnet 144 as described above. The magnet 144 can be coupled to a coil positioned in the ear canal as described above. The assembly 200 comprising the magnet transducer can be positioned in a hole drilled into the cochlear bone to a predetermined depth within a range from about 0.3 to about 3 mm. The assembly 200 can be screwed into the hole. A stop 120S can limit penetration to a predetermined depth Ls as noted above.

Figure 2C:
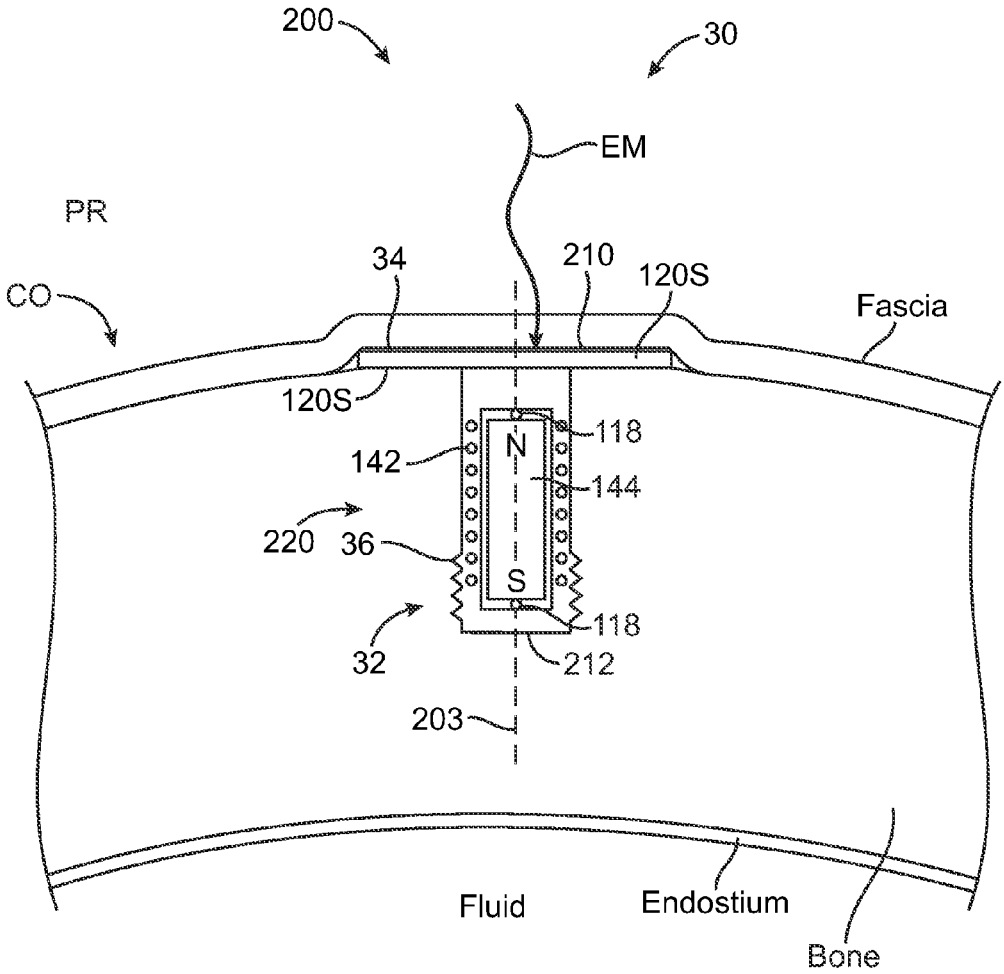
FIG. 2C shows a schematic illustration of a fixed length output assembly, in accordance with embodiments.

FIG. 2C shows a schematic illustration of a fixed length output assembly 200. The fixed length output assembly comprises many of the components as described above. The assembly 200 comprises an axis 203 extending along the fixed length. The coil, magnet and threads can extend along the axis. The transducer 130 may comprise a photovoltaic photodetector disposed on an upper surface to receive light energy through the posterior portion of the eardrum. The stop 120S can be located near the photodetector and may comprise a support of the photodetector so as to comprise a low profile when positioned under the fascia. Alternatively, the stop can be located near the end 212 to limit penetration into the bone. The spring structure 118 may comprise a resilient material, such as an elastomer, for example an elastomer O-ring or ball or pad. The spring structure 118 can allow the magnet 144 to slide within a chamber of the transducer in response to current through the coil that is coupled to the photovoltaic photodetector. While a coil and magnet in an axial arrangement are shown in the drawing, the transducer assembly may comprise one or more of many transducers such as balanced armature transducer, a piezoelectric transducer, a magnetostrictive transducer or a photostrictive transducer, as described herein.

Figure 2D:
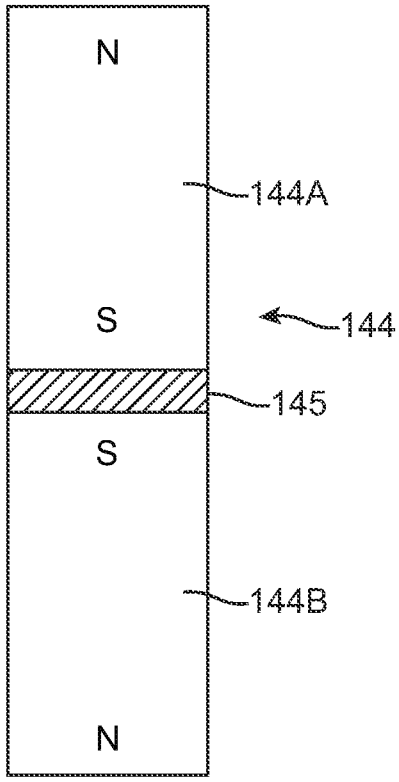
FIG. 2D shows a magnet comprising a pair of opposing magnets for use with the transducer of the output assembly, in accordance with embodiments.

FIG. 2D shows magnet 144 comprising a pair of opposing magnets for use with the transducer of the output assembly as described herein. The pair of opposing magnets comprises a first magnet 144A and a second magnet 144B. The first magnet 144A comprises a first magnetic field and the second magnet 144B comprises a second magnetic field. The first magnetic filed is oriented so as to oppose the second magnetic field, for example with a south pole of the first magnet oriented toward a south pole of the second magnet. The pair of opposing magnets can provide decreased sensitivity to external magnetic fields, for example transient magnetic fields that may cause noise and magnetic fields such as from MRI machines that may cause displacement.

Figure 2E:
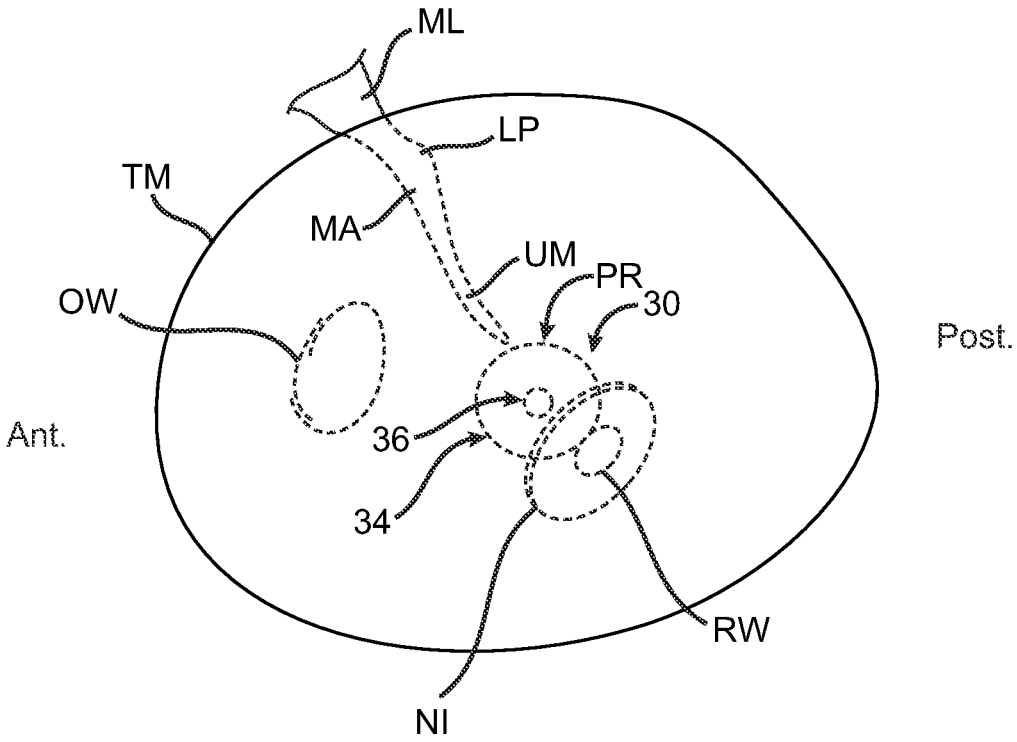
FIG. 2E shows the photodetector of the output assembly positioned to receive light energy transmitted through a posterior portion of the eardrum, in accordance with embodiments.

FIG. 2E shows the photodetector of the output assembly 30 positioned on the promontory so as to receive light energy transmitted through a posterior portion of the eardrum, for example an inferior posterior portion of the eardrum.

Figure 3:
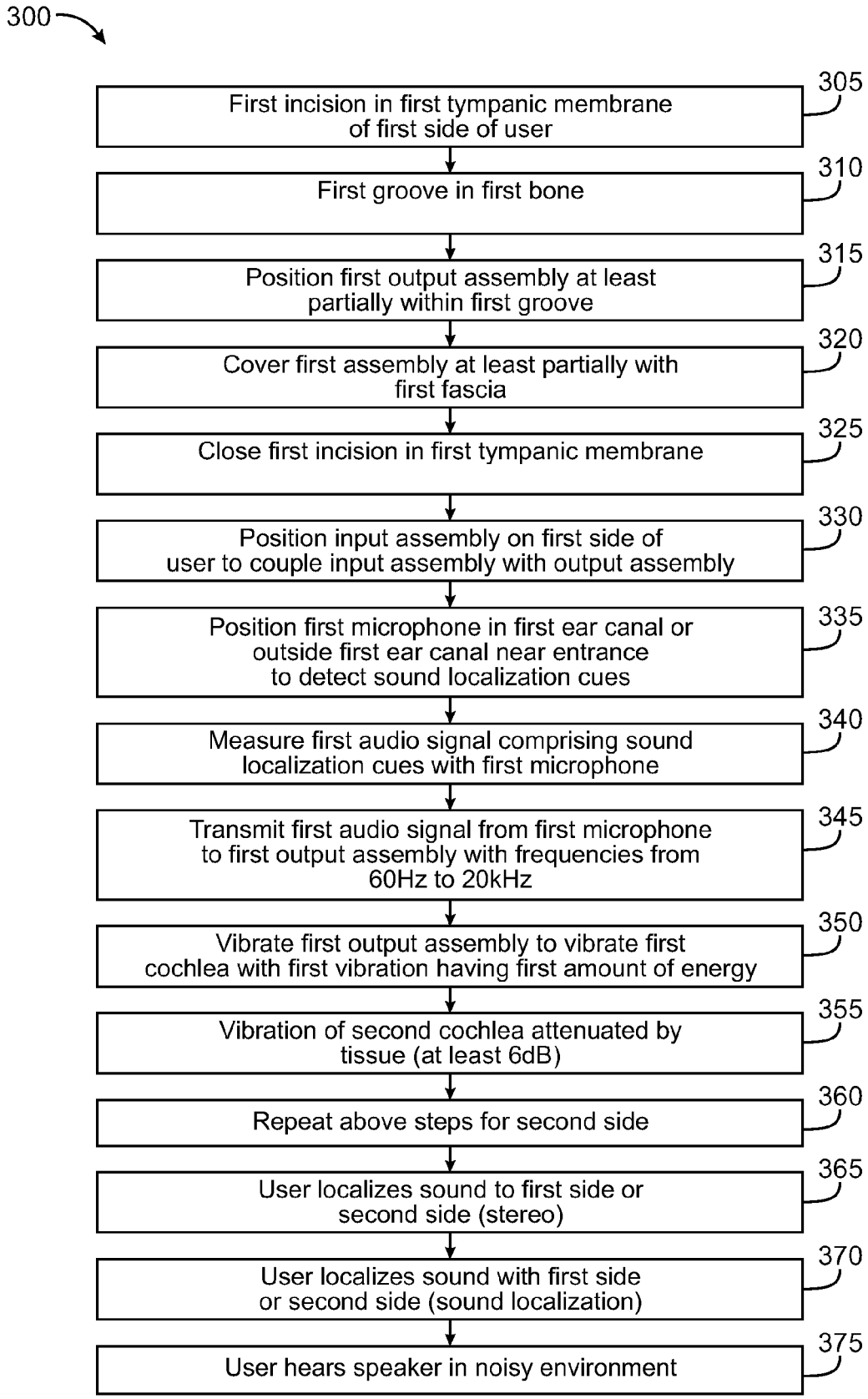
FIG. 3 shows a method of transmitting sound to a user with side specificity and sound localization cues, in accordance with embodiments of the present invention.

FIG. 3 shows a method of transmitting sound to a user with side specificity and sound localization cues. A step 305 make a first incision in a first tympanic membrane of a first side of the user. A step 310 makes a first groove or channel in first bone. The bone may comprise mastoid bone or cochlear bone. A step 315 positions the first output assembly at least partially within the first groove or channel. A step 320 covers the first output assembly at least partially with first fascia. A step 325 closes the first incision in the first tympanic membrane. A step 330 positions the input assembly on the first side of the user to couple the input assembly with the implanted output assembly. A step 335 positions a first microphone in a first ear canal or the first ear canal near the ear canal entrance to detect the sound localization cues, as described above. A step 340 measures a first audio signal comprise a sound localization cues on a with the first microphone. A step 345 transmits the first audio signal from the first microphone to the first output assembly with frequencies from about 60 Hz to about 20 kHz. A step 350 vibrates the first output assembly with a first vibration having the first amount of energy. A step 355 vibrates the second cochlea with sound attenuated by tissue of the user disposed between the first transducer on the first side and the second cochlea on the second side. For example attenuation may comprise at least about 6 dB. The tissue disposed between the first transducer on the first side and the second cochlea on the second side may comprise tissue of the skull. A step 360 repeats the above steps for the second system positioned on the second side, as described above. With a step 370, the user localizes sound to the first side or the second side with stereo. With a step 375, the user localizes the sound within the first side or the second side. With a step 375, the user hears a speaker such as a person in a noisy environment, for example based on the sound localization cues.

The sound processor comprising a tangible medium as described above can be configured with software comprising instructions of a computer program embodied thereon implant many of the steps described above. The surgeon may implant the output assembly and the user may position the input assembly, as noted above.

It should be appreciated that the specific steps illustrated in FIG. 3 provides a particular method transmitting a sound to a user, according to some embodiments of the present invention. Other sequences of steps may also be performed according to alternative embodiments. For example, alternative embodiments of the present invention may perform the steps outlined above in a different order. Moreover, the individual steps illustrated in FIG. 3 may include multiple sub-steps that may be performed in various sequences as appropriate to the individual step. Furthermore, additional steps may be added or removed depending on the particular applications. One of ordinary skill in the art would recognize many variations, modifications, and alternatives.

Experimental

Based on the teachings described herein, a person of ordinary skill in the art can conduct experimental studies to determine empirically the configuration of the coupling of the transducer to bone, such that the user can localize sound to the left side or the right side, and such that the user can detect sound localization cues. For example, experiments can be conducted to determine attenuation of sound of the second cochlea relative to the cochlea with the output assembly coupled to mastoid bone or to cochlear bone so as to determine suitable bone for coupling. Further the embodiments described above can be coupled to the mastoid bone or the cochlear bone to determine embodiments that provide suitable side localization and sound localization cues as described above.

Human Eardrum Transmission Experiment

The below described experiment was conducted to measure transmission of infrared light through the eardrum and determine arrangements of the input assembly 20 and output assembly 30.

Objective: To determine the amount of light transmission loss through a human eardrum at posterior, inferior and anterior positions and the amount of scatter by the eardrum.

Figure 4:
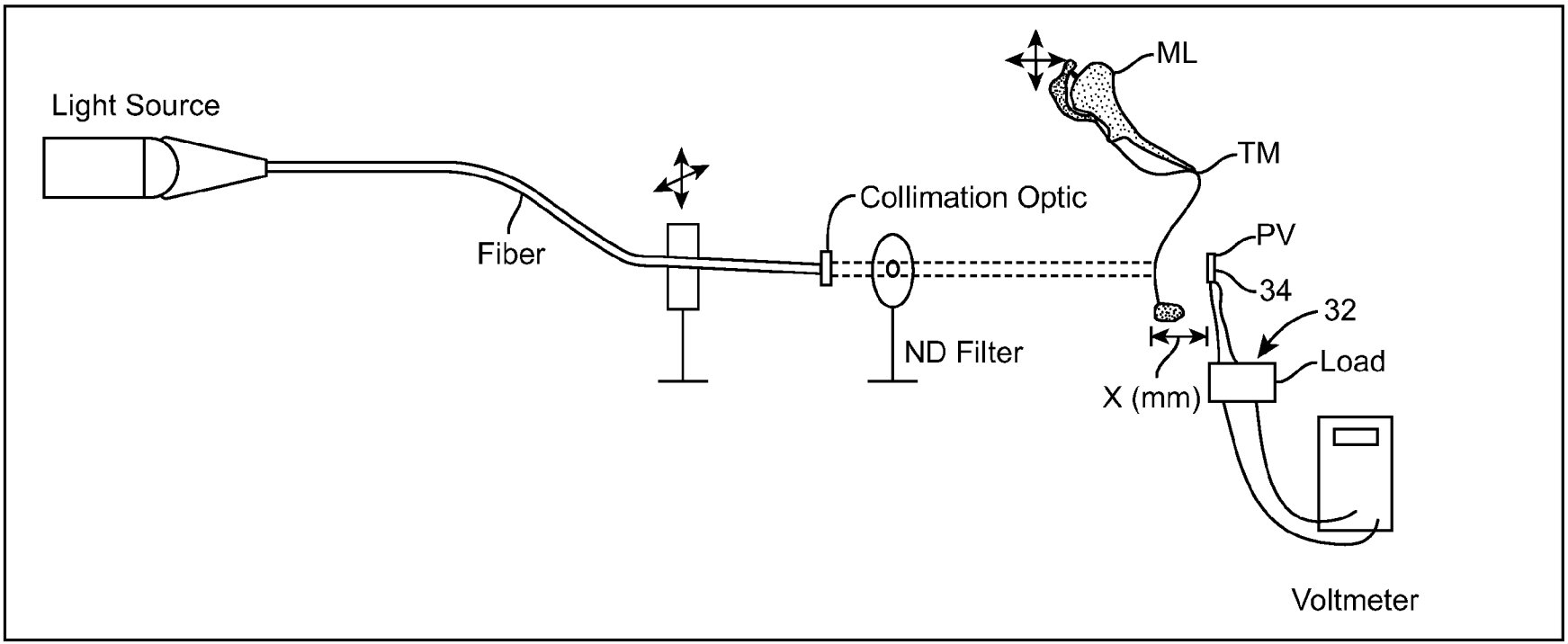
FIG. 4 shows an experimental set up to determine optical transmission through the tympanic membrane, in accordance with embodiments.

Procedure:

FIG. 4 shows the experimental set up to determine optical transmission through the tympanic membrane, in accordance with embodiments. A fiber optic coupled laser diode light source was aligned with a photodiode optical detector. An eardrum was placed in line and the change in optical output from the photodiode determined. The eardrum is mounted to a x, y, z translation stage which allows a change to different positions of the eardrum that the light goes through.

Materials:

Light source—1480 nm laser diode coupled to an optical fiber (250 um diameter, 80 um core);

PhotoDiode—1480 nm photodiode (5.5 mm2);

Load—RLC electrical circuit equivalent to that of a balanced armature transducer coupled to a diaphragm, which can be suitable for determining transmission through the eardrum.

Collimation optics and a Neutral Density Filter (NE20B);

DC Voltmeter (Fluke 8060A);

Translation stages; and

Human Cadaver Eardrum with Attached Malleus (Incus and Other Medial Components Removed)

Results

No Tympanic Membrane

The current was set such that the photodiode was in the saturation region. A neutral density (ND) filter was used to attenuate the light output to reduced the PD response. The measurements indicate that the ND filter attenuated the light source by 20.5 dB. This ensured that all measurements reported are from the linear region.

The photodiode voltage in response to the collimated light beam without the eardrum was measured at the beginning of the measurements and at the end of experiment. The difference was less than 1%.

With no TM and ND filter, the output in mV was 349. With the ND filer and no TM, this output decreased to within a range from about 32.9 to 33.1, corresponding to a linear change of 0.095 and −20.5 dB.

With Tympanic Membrane

Measurements were made at anterior, inferior, and posterior positions of the eardrum. The eardrum was moved at different locations relative to the photodiode and it's distance X (in mm) approximated. Table 1 shows the measured voltages corresponding to the different positions and different eardrum locations.

TABLE 1

| Measured photodiode voltages corresponding to transmission loss from the eardrum | | | | | |
|---|---|---|---|---|---|
| | x (mm) | | | | |
| | 0.1 | 0.5 | 1 | 2 | 3 |
| Posterior | 28 mV | 26.6 mV | 25.4 mV | 23.4 mV | 20.6 mV |
| Inferior | | | 23.6 mV | 21.1 mV | 17.1 mV |
| Anterior | | | 21.4 mV | 20.2 mV | 18.2 mV |

The posterior placement shows the highest voltage for all distances and has values of 28, 26.6, 25.4 23.4 and 20.6 for distances of 0.1, 0.5, 1, 2 and 3 mm, respectively.

For each eardrum position and location, the optical fiber was adjusted to maximize the PD voltage. This ensured that the light beam was maximally on the photodiode surface and that the measured response was due to transmission loss and not due to misalignments.

Calculations

The measured voltages were converted to percent transmission loss (hereinafter "TL") as follows:

$$\% \text{ TL}=((V_{NoTM}-V_{WithTM})/V_{NoTM})*100$$

where $V_{NoTM}$ is the measured voltage with no tympanic membrane and $V_{WithTM}$ is the measured voltage with the tympanic membrane Table 2 below shows the calculated % Transmission Loss using the above equation.

TABLE 2

| % Transmission loss | | | | | |
|---|---|---|---|---|---|
| | x (mm) | | | | |
| | 0.1 | 0.5 | 1 | 2 | 3 |
| Posterior | 16 | 20 | 23 | 29 | 38 |
| Inferior | | | 29 | 36 | 48 |
| Anterior | | | 35 | 39 | 45 |
| Average | | | 29 | 35 | 44 |

At all locations the posterior placement showed the least transmission loss and values of 16, 20, 23, 29 and 38% at distances of 0.1, 0.5, 1, 2 and 3 mm, respectively.

With the PD very close to the eardrum (within about 0.1 mm), the TL is about 16%. The TL could only be measured for the Posterior position.

Of the three positions of the eardrum, the posterior position is better than the inferior position by 6-10%, and better than the anterior position by 7-12%.

As the eardrum is moved away from the PD, the transmission loss increases linearly for all three positions. The average transmission loss is about 29%, 35%, and 44% averaged across the three different positions for the 1, 2 and 3 mm locations respectively.

EXPERIMENTAL CONCLUSIONS

The transmission loss due to the eardrum is lowest at the posterior position (16%). The loss increases as the photodiode is moved away from the eardrum due to scatter of the collimated beam by the eardrum. At 3 mm from the eardrum, the average loss was as much as 44%. These data shown the unexpected result that there is more loss due to light scatter at angles away from the detector surface induced by the eardrum than due to transmission of light through the eardrum, and the detector and coupler such as a lens can be shaped appropriately so as to collect transmitted light scattered by the eardrum. These data also show the unexpected result that light transmission is higher through the posterior portion of the eardrum.

As the eardrum can move, the detector in a living person should be at least about 0.5 mm from the eardrum. The data suggest that a detector and/or component such as a lens can be shaped to fit the eardrum and provide improved transmission, for example shape with one or more of an inclined surface, a curved surface, and can be positioned within a range from about 0.5 mm to about 2 mm, for example.

The above data shows that illuminating a portion of the eardrum and placing a detector near the illuminated portion, for example can achieve transmission coupling efficiency between the projected light beam and detector of a least about 50% (corresponding to 50% loss), for example at least about 60% (corresponding to 40% loss). With posterior placement of the detector and illumination of a portion of the posterior region of the eardrum, the coupling efficiency can be at least about 70%, for example 80% or more. These unexpectedly high results for coupling efficiency indicate that illumination of a portion of the eardrum and a detector sized to the illuminated portion can provide efficiencies of at least about 50%. Also, the unexpected substantially lower transmission loss for the posterior portion of the eardrum as compared to each of the inferior and anterior portions indicates that transmission can be unexpectedly improved with posterior placement when most of the eardrum is illuminated. For example, the transmission coupling efficiency of the optical fiber to the photodetector can be improved substantially when the photodetector is positioned in the posterior portion of the middle ear cavity, for example the inferior posterior portion of the middle ear cavity, and an optical fiber is positioned in the ear canal without collimation optics such that light is emitted directly into the ear canal from the end of the optical fiber. Also, the high amount of light transmission through the eardrum shows that the signal optically transmitted through the eardrum can vibrate the bone so as to stimulate the cochlea such that the user perceives sound.

While the exemplary embodiments have been described in some detail, by way of example and for clarity of understanding, those of skill in the art will recognize that a variety of modifications, adaptations, and changes may be employed. Hence, the scope of the present invention should be limited solely by the appended claims and the full scope of the equivalents thereof.

What is claimed is:

1. A device to transmit a sound to a user having a cochlea on a first side and a second cochlea on a second side, the device comprising:

an input assembly configured to receive a sound input, the input assembly comprising a light source to transmit a light; and an output assembly comprising an output transducer configured to couple to a substantially fixed bone tissue to transmit the sound and vibrate the cochlea on the first side with bone conduction of the substantially fixed bone tissue, wherein the sound transmitted to the cochlea is substantially attenuated at the second cochlea, the output assembly further comprising, at least one photodetector to receive the light, an anchor configured to affix the output transducer assembly to the substantially fixed bone tissue and support the output assembly with the substantially fixed bone tissue of the ear;

wherein the output transducer vibrates the substantially fixed bone tissue to transmit the sound to the user with bone conduction in response to the light and wherein the transducer is configured to vibrate the second cochlea located on the second side of the user with substantial attenuation of the sound at the second cochlea sufficient for the user to localize the sound to the first side.

2. The device of claim 1 wherein the output assembly is configured to couple to the bone tissue to decrease stimulation of a second cochlea of the user.

3. The device of claim 1 wherein the substantially fixed bone tissue comprises at least one of a cochlear bone tissue, a temporal bone tissue, or a mastoid bone tissue.

4. The device of claim 3 wherein the temporal bone tissue comprises the cochlear bone tissue and wherein the output assembly is configured to couple to the cochlear bone tissue.

5. The device of claim 4 wherein the cochlear bone tissue comprises a promontory disposed between the cochlea and a middle ear.

6. The device of claim 5 wherein the promontory comprises a rounded prominence formed by a projection outward of the first turn of the cochlea and wherein the output assembly comprises an anchor sized to the promontory.

7. The device of claim 4 wherein the output assembly is configured to extend at least partially into the cochlear bone tissue to couple to the cochlea to decrease stimulation of a second cochlea of the user.

8. The device of claim 7 wherein the output assembly is configured to extend into the cochlear bone tissue a distance within a range from about 0.5 mm to about 3 mm to couple the transducer to the bone tissue.

9. The device of claim 8 wherein the output assembly comprises a stop to limit a penetration depth of the output assembly into the cochlear bone tissue.

10. The device of claim 1 wherein the input assembly comprises a microphone configured for placement on the first side of the user to generate a signal in response to the sound, and wherein the input assembly is configured to transmit the signal to the output assembly to localize the sound to the first side.

11. The device of claim 1 wherein the sound transmitted to the cochlea comprises a first amount and the sound transmitted to the second cochlea comprises a second amount, wherein the second amount is at least about 6 dB less than the first amount.

12. The device of claim 11 wherein the second amount is at least about 10 dB less than the first amount.

13. The device of claim 12 wherein the second amount is at least about 20 dB less than the first amount.

14. The device of claim 1 wherein a microphone is configured for placement on the first side outside an ear canal near an opening of the ear canal or within the ear canal to transmit sound comprising spatial localization cues and frequencies of at least about 4 kHz to the cochlea.

15. The device of claim 14 wherein the transducer is configured to vibrate the cochlea on the first side with the frequencies of at least about 4 kHz.

16. The device of claim 14 wherein the microphone is configured to measure sound having frequencies within a range from about 60 Hz to at least about 15 kHz and the transducer is configured to vibrate the cochlea on the first side with the range of frequencies from about 60 Hz to at least about 15 kHz.

17. The device of claim 16 wherein the microphone is configured to measure sound having frequencies within a range from about 60 Hz to about 20 kHz and the transducer is configured to vibrate the cochlea on the first side with the range of frequencies from about 60 Hz to about 20 kHz.

18. The device of claim 1 further comprising an anchor configured to affix to the bone tissue.

19. The device of claim 18 wherein the anchor comprises at least one of protrusions, holes or recesses to couple to the bone.

20. The device of claim 19 wherein the anchor comprises the protrusions and the recesses and wherein the protrusions and the recesses comprise threads shaped to screw the anchor into the cochlear bone tissue.

21. A system to transmit a sound to a user having a first ear on a first side and a second ear on a second side, the first ear having a first cochlea on the first side, the second ear having a second cochlea on the second side, the system comprising:

a first input assembly configured to receive a first sound with a first microphone on the first side of the user, the first input assembly comprising a first light source to transmit a first light;

a first output assembly comprising a first transducer configured to couple to a first substantially fixed bone tissue on the first side to transmit the first sound to the user with bone conduction of the first substantially fixed bone tissue, the output transducer assembly further comprising, at least one first photodetector to receive the first light, a first anchor configured to affix the first output transducer assembly to the first substantially fixed bone tissue and support the first output assembly with the first substantially fixed bone tissue of the ear, wherein the first output transducer vibrates the first substantially fixed bone tissue to transmit the first sound to the user with bone conduction in response to the first light and wherein the first sound transmitted to the first cochlea is substantially attenuated at the second cochlea and wherein the first transducer is configured to vibrate the second cochlea located on the second side of the user with substantial attenuation of the sound at the second cochlea sufficient for the user to localize the sound to the first side;

a second input assembly configured to receive a second sound with a second microphone on a second side of the user, the second output transducer assembly comprising a second light source to transmit a second light; and a second output assembly comprising a second transducer configured to couple to a second substantially fixed bone tissue of on the second side to transmit the second sound to the user with bone conduction of the second substantially fixed bone tissue, the output transducer assembly further comprising, at least one second photodetector to receive the second light, a second anchor configured to affix the second output transducer assembly to the second substantially fixed bone tissue and support the second output assembly with the second substantially fixed bone tissue, wherein the second output transducer vibrates the second substantially fixed bone tissue to transmit the second sound to the user with bone conduction in response to the second light and wherein the second sound transmitted to the second cochlea is substantially attenuated at the first cochlea and wherein the second transducer is configured to vibrate the first cochlea located on the first side of the user with substantial attenuation of the sound at the first cochlea sufficient for the user to localize the sound to the second side.

22. The system of claim 21 wherein the first microphone is configured to measure a first sound of the first side and the first output assembly is configured to transmit the first sound of the first side to a first cochlea of the first side and wherein the second microphone is configured to measure a second sound of the second side and the second output assembly is configured to transmit the second sound of the second side to a second cochlea of the second side.

23. The system of claim 21 wherein the first microphone is configured to measure a first sound localization cue and the first output assembly is configured to transmit the first sound localization cue to a first cochlea of the first side and the second microphone is configured to measure a second sound localization cue and the second output assembly is configured to transmit the second sound localization cue to a second cochlea of the second side.

24. The system of claim 23 wherein the first output assembly and the second output assembly are configured to transmit the first and second sounds to the first and second cochleae, respectively, such that the user perceives the first sound on the first side and the second sound on the second side.

25. A method of transmitting sound to a user having an ear comprising substantially fixed bone tissue, the user having a cochlea are located on a first side of the user and a second cochlea located on a second side opposite the first side, the method comprising:

transmitting light energy from an input assembly to an output transducer connected to the substantially fixed bone tissue;

receiving the light energy with at least one photodetector of an output assembly comprising the output transducer, and vibrating the substantially fixed bone tissue with the output transducer in response to the light energy to transmit the sound to the user with bone conduction, wherein the transducer vibrates the cochlea with a first amount of energy in response to the light energy and vibrates the second cochlea with a second amount of energy in response to the light energy, and wherein the second amount is less than the first amount such that the user localizes the sound to the first side.

26. The method of claim 25 wherein the light energy comprises light energy transmitted through the eardrum to vibrate the transducer.

27. The method of claim 25 wherein fascia tissue is positioned over the transducer and wherein the light energy comprises light energy transmitted through the fascia to vibrate the transducer.

28. The method of claim 27 wherein the light energy is transmitted through a posterior portion of the eardrum to vibrate the transducer.

29. The method of claim 25 wherein a skull of the user attenuates the vibration of the transducer transmitted from the first side to the second side by at least about 6 dB such that the user localizes the sound to the first side.

30. The method of claim 25 wherein the light energy comprises an audio signal from a first microphone on the first side.

31. The method of claim 30 wherein the microphone is positioned in an ear canal or near an ear canal opening and wherein the audio signal comprises sound localization cues having frequencies above about 4 kHz.

32. The method of claim 30 further comprising a second microphone on the second side and a second transducer coupled to the substantially fixed bone tissue on the second side and wherein second transducer vibrates the second cochlea in response to a second light energy and wherein the user localizes the sound to the second side in response to the second light energy.

33. A method of providing an output assembly to transmit sound to a user having an ear comprising a substantially fixed bone tissue, the user having a cochlea are located on a first side of the user and a second cochlea located on a second side opposite the first side, the method comprising:

providing the output assembly comprising an output transducer, the output assembly comprising at least one photodetector to receive a light energy;

forming a channel in the substantially fixed bone tissue; and positioning an end of the assembly at least partially within the channel to couple the transducer to the substantially fixed bone tissue, wherein the output transducer vibrates the substantially fixed bone tissue in response to the light energy to transmit the sound to the user with bone conduction, wherein the transducer vibrates the cochlea with a first amount of energy in response to the light energy and vibrates the second cochlea with a second amount of energy in response to the light energy, and wherein the second amount is less than the first amount such that the user localizes the sound to the first side.

34. The method of claim 33 wherein fascia tissue is positioned over the at least one photodetector when the output assembly device is positioned at least partially within the channel.

35. The method of claim 33 wherein the output assembly is affixed to the substantially fixed bone tissue when the device is positioned at least partially within the channel.

36. A device to transmit a sound to a user having an ear having a substantially fixed bone tissue, the user having a cochlea are located on a first side of the user and a second cochlea located on a second side opposite the first side, the device comprising:

input assembly means for transmitting a light signal; and output assembly means for receiving the light signal and vibrating the substantially fixed bone tissue in response to the light signal to transmit the sound to the user with bone conduction, wherein the output assembly means vibrates the cochlea with a first amount of energy in response to the light energy and vibrates the second cochlea with a second amount of energy in response to the light energy, and wherein the second amount is less than the first amount such that the user localizes the sound to the first side.

* * * * *